US011111650B2

(12) United States Patent
Takahashi et al.

(10) Patent No.: US 11,111,650 B2
(45) Date of Patent: Sep. 7, 2021

(54) HYDRAULIC DRIVE SYSTEM FOR CONSTRUCTION MACHINE

(71) Applicant: Hitachi Construction Machinery Tierra Co., Ltd., Koka (JP)

(72) Inventors: Kiwamu Takahashi, Moriyama (JP); Taihei Maehara, Koka (JP); Takeshi Ishii, Hino-cho (JP); Yoshifumi Takebayashi, Koka (JP); Natsuki Nakamura, Koka (JP); Daisuke Oka, Yasu (JP)

(73) Assignee: Hitachi Construction Machinery Tierra Co. Ltd., Koka (JP)

( * ) Notice: Subject to any disclaimer, the term of this patent is extended or adjusted under 35 U.S.C. 154(b) by 217 days.

(21) Appl. No.: 16/492,482

(22) PCT Filed: May 23, 2018

(86) PCT No.: PCT/JP2018/019890

§ 371 (c)(1),
(2) Date: Sep. 9, 2019

(87) PCT Pub. No.: WO2019/064688

PCT Pub. Date: Apr. 4, 2019

(65) Prior Publication Data

US 2021/0131069 A1 May 6, 2021

(30) Foreign Application Priority Data

Sep. 29, 2017 (JP) ..... JP2017-191557

(51) Int. Cl.
*E02F 9/22* (2006.01)
*F15B 11/17* (2006.01)

(52) U.S. Cl.
CPC ..... *E02F 9/2235* (2013.01); *E02F 9/22* (2013.01); *E02F 9/2285* (2013.01);
(Continued)

(58) Field of Classification Search
CPC ..... E02F 9/22; E02F 9/2235; E02F 9/2296; E02F 9/2292; E02F 9/2285;
(Continued)

(56) References Cited

U.S. PATENT DOCUMENTS 6,183,210 B1 * 2/2001 Nakamura ..... E02F 9/2235 417/222.1
7,076,947 B2 * 7/2006 Ariga ..... E02F 9/2232 60/452

(Continued)

FOREIGN PATENT DOCUMENTS

JP 2002-242904 A 8/2002
JP 2007-247731 A 9/2007

(Continued)

OTHER PUBLICATIONS

International Preliminary Report on Patentability (PCT/IB/338 & PCT/IB/373) issued in PCT Application No. PCT/JP2018/019890 dated Apr. 9, 2020, including English translation of document C2 (Japanese-language Written Opinion (PCT/ISA/237) previously filed on Sep. 9, 2019) (seven pages).

(Continued)

*Primary Examiner* — Dustin T Nguyen
(74) *Attorney, Agent, or Firm* — Crowell & Moring LLP

(57) ABSTRACT

When a swing motor and a boom cylinder are driven simultaneously, a hydraulic drive system appropriately adjusts a distribution of torques between hydraulic pumps and feeds back a torque actually consumed by the hydraulic pump for actuating the swing motor accurately to the hydraulic pump for actuating the boom cylinder. To that end, when boom raising and swinging are performed simultaneously, the hydraulic drive system corrects an allowable torque of a hydraulic pump 302 that supplies a hydraulic fluid to a swing motor 3*c* so as to be lowered by a certain ratio, reducing allowable torques of hydraulic pumps 102 and 202 that supply a hydraulic fluid to a boom cylinder 3*a* by torques consumed by the hydraulic pumps 102 and 202 that supply a hydraulic fluid to the swing motor 3*c*.

5 Claims, 14 Drawing Sheets

(52) U.S. Cl.
CPC ..... *E02F 9/2292* (2013.01); *E02F 9/2296* (2013.01); *F15B 11/17* (2013.01); *F15B 2211/20553* (2013.01); *F15B 2211/20576* (2013.01); *F15B 2211/6652* (2013.01); *F15B 2211/7051* (2013.01); *F15B 2211/7058* (2013.01); *F15B 2211/7135* (2013.01)

(58) Field of Classification Search
CPC .... F15B 2211/6652; F15B 2211/20576; F15B 2211/20584; F15B 2211/20592; F15B 2211/20553; F15B 11/17
See application file for complete search history.

(56) References Cited

U.S. PATENT DOCUMENTS 7,272,928 B2 * 9/2007 Ariga ..... E02F 9/2232 60/428
8,006,491 B2 * 8/2011 Narazaki ..... E02F 9/2235 60/452
8,162,618 B2 * 4/2012 Nakamura ..... F04B 49/08 417/34
8,371,117 B2 * 2/2013 Nakamura ..... F15B 11/17 60/449
9,181,684 B2 * 11/2015 Okano ..... E02F 9/2292
9,341,198 B2 * 5/2016 Nakamura ..... F15B 15/20
10,676,898 B2 * 6/2020 Takahashi ..... E02F 9/2267
2016/0333900 A1 11/2016 Takahashi et al.

FOREIGN PATENT DOCUMENTS

JP 2014-240629 A 12/2014
JP 2015-148236 A 8/2015

OTHER PUBLICATIONS

International Search Report (PCT/ISA/210) issued in PCT Application No. PCT/JP2018/019890 dated Aug. 14, 2018 with English translation (two (2) pages).
Japanese-language Written Opinion (PCT/ISA/237) issued in PCT Application No. PCT/JP2018/019890 dated Aug. 14, 2018 (three (3) pages).

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator or the like, and more particularly to a hydraulic drive system that drives a plurality of actuators with a plurality of hydraulic pumps and limits absorption torques of the hydraulic pumps such that the sum of consumption torques of the hydraulic pumps does not exceed a predetermined value, i.e., performs so-called horsepower control.

BACKGROUND ART

Patent Document 1 discloses an arrangement in which three variable-displacement hydraulic pumps are used and the delivery pressure of the third hydraulic pump is limited by a pressure reducing valve and fed back to regulators of the first and second hydraulic pumps.

Patent Document 2 discloses in its embodiment 1 a controller for a construction machine such as a hydraulic excavator that has a first hydraulic pump for actuating a swing motor and a second hydraulic pump for actuating a work implement including a boom, an arm, and so on. In an independent swing operation mode for independently actuating an upper swing structure, the controller computes an allowable torque of the first hydraulic pump for actuating the swing motor from the magnitude of a swing operation signal. In a combined operation mode for swinging the upper swing structure and raising the boom, the controller computes an allowable torque of the first hydraulic pump for actuating the swing motor from the magnitude of a swing operation signal, and computes an allowable torque of the second hydraulic pump by subtracting the allowable torque of the first hydraulic pump computed as described above from a maximum allowable torque of the second hydraulic pump at the time the upper swing structure is not swung.

PRIOR ART DOCUMENT

Patent Documents

Patent Document 1: JP-2002-242904-A
Patent Document 2: JP-2007-247731-A

SUMMARY OF THE INVENTION

Problems to be Solved by the Invention

According to the arrangement disclosed in Patent Document 1, since the flow rate of a hydraulic fluid delivered from the third hydraulic pump is controlled by only the delivery pressure of the third hydraulic pump, the hydraulic fluid delivered from the third hydraulic pump that actuates a particular actuator (such as a swing motor) flows at a stable flow rate without being affected by variations of the flow rates of a hydraulic fluid delivered from the first and second hydraulic pumps.

Furthermore, the prime mover for actuating the three hydraulic pumps is prevented from stalling by controlling the sum of torques consumed by the three hydraulic pumps not to exceed a predetermined value, i.e., by performing so-called horsepower control. Moreover, as the third hydraulic pump is of the variable-displacement type and the delivery pressure thereof is fed back to the first and second pumps through the pressure reducing valve, even if the load pressure on the third hydraulic pump is large, the delivery pressure of the third hydraulic pump is limited by the pressure reducing valve. Therefore, the rates of the hydraulic fluid delivered from the first and second hydraulic pumps are not reduced to extremes, and other actuators (a boom, an arm, and so on) than the particular actuator (such as a swing motor) driven by the third hydraulic pump are prevented from suffering an excessive reduction in speed, resulting in good combined operability.

However, the prior art disclosed in Patent Document 1 poses the following problems:

When the swinging and the boom raising are performed simultaneously, the flow rate of the third hydraulic pump that actuates the swing motor is limited by only the load pressure on the swing motor, and the flow rates of the first and second hydraulic pumps that actuate a boom cylinder are limited by the torque consumed by the third hydraulic pump. Consequently, if the third hydraulic pump that actuates the swing motor has a relatively small torque setting, then the good combined operability is achieved as described in Patent Document 1. However, if the third hydraulic pump that actuates the swing motor has a relatively large torque setting, then the torque consumed by the third hydraulic pump is fed back to the first and second hydraulic pumps, greatly lowering the flow rates of the hydraulic fluid supplied from the first and second hydraulic pumps to the boom cylinder. Therefore, the boom raising tends to lag behind the operation of the swing motor, resulting in impaired operability.

According to a specific example, in a task for loading soil scooped up by the bucket onto the cargo bed of a dump truck parked near the hydraulic excavator, the boom raising lags in a manner not intended by the operator, and the bucket is not raised to a height that is enough to exceed the gate of the cargo bed, with the result that the bucket or arm of the hydraulic excavator may hit the gate of the cargo bed.

Using the above arrangement disclosed in Patent Document 2, it is possible to adjust the horsepower ratio of a hydraulic fluid supplied to the work implement and the swing motor based on a swing operation amount and a working operation amount (e.g., a boom raising operation amount), so that the horsepower ratio of the two hydraulic pumps can be adjusted as intended by the operator.

However, the prior art disclosed in Patent Document 2 suffers the following problems:

According to Patent Document 2, as described above, the allowable torque of the hydraulic pump for actuating the swing motor is determined by only the swing operation amount. Actually, however, since the torque that is consumed by the hydraulic pump for actuating the swing motor is determined by an equation proportional to the product of the delivery pressure of the hydraulic pump for actuating the swing motor and the flow rate at the time, the torque that is actually consumed by the hydraulic pump for actuating the swing motor cannot accurately be grasped with the swing operation amount.

For example, even if the swing operation amount is maximum, the load pressure on the swing motor is small providing the swing rotational speed does not increase constantly. According to the prior art disclosed in Patent Document 2, inasmuch as the allowable torque of the hydraulic pump for actuating the swing motor is determined by only the swing operation amount, even if the load pressure on the swing motor is small in the complex operation mode for performing the swinging and the boom raising simultaneously, the allowable torque of the hydraulic pump for actuating the boom cylinder is reduced by the allowable torque of the hydraulic pump for actuating the swing motor. Therefore, the allowable torque of the hydraulic pump for actuating the boom cylinder is likely to be reduced unnecessarily, resulting in a problem that the torque that the prime mover has is not used effectively.

It is an object of the present invention to provide a hydraulic drive system for a construction machine having a plurality of variable-displacement hydraulic pumps and a swing motor and a boom cylinder that are actuated respectively by the different hydraulic pumps, in which the hydraulic drive system performs so-called horsepower control that controls the hydraulic pumps such that the sum of consumption torques of the hydraulic pump for actuating the swing motor and the hydraulic pump for actuating the boom cylinder does not exceed a predetermined value, wherein when the swing motor and the boom cylinder are driven simultaneously, a distribution of torques between the hydraulic pumps can be appropriately adjusted regardless of respective torque settings of the hydraulic pump for actuating the swing motor and the hydraulic pump for actuating the boom cylinder when the swing motor and the boom cylinder are driven independently of each other, and feeds back the torque actually consumed by the hydraulic pump for actuating the swing motor accurately to the hydraulic pump for actuating the boom cylinder, thereby realizing excellent combined operability and effective use of the output torque of a prime mover.

Means for Solving the Problems

In order to achieve the above object, the present invention provides a hydraulic drive system for a construction machine, the hydraulic drive system comprising: a plurality of hydraulic pumps including variable-displacement first and second hydraulic pumps driven by a prime mover; a plurality of actuators driven by hydraulic fluids delivered from the plurality of hydraulic pumps; a first regulator to which a delivery pressure of the first hydraulic pump is introduced and that controls a displacement volume of the first hydraulic pump such that a torque consumed by the first hydraulic pump does not exceed a first allowable torque; a second regulator to which a delivery pressure of the second hydraulic pump is introduced and that controls a displacement volume of the second hydraulic pump such that a torque consumed by the second hydraulic pump does not exceed a second allowable torque; and a first valve device that generates a first output pressure to feed back the torque consumed by the second hydraulic pump to the first regulator based on the delivery pressure of the second hydraulic pump, wherein the first regulator includes a first operation drive section to which the first output pressure is introduced and with the first operation drive section, the first regulator corrects a horsepower control starting pressure for securing the first allowable torque so as to be smaller by the first output pressure thereby to control the displacement volume of the first hydraulic pump such that a sum of the torques consumed by the first and second hydraulic pumps does not exceed a predetermined value, and the plurality of actuators include a boom cylinder for driving a boom of a front work implement and a swing motor for driving an upper swing structure, the boom cylinder being driven by a hydraulic fluid delivered by the first hydraulic pump, and the swing motor being driven by a hydraulic fluid delivered by the second hydraulic pump, and wherein the hydraulic drive system further comprises: a controller that, when the swing motor and the boom cylinder are driven simultaneously, calculates a correction value for the horsepower control starting pressure for reducing the second allowable torque of the second hydraulic pump so as to be smaller than a maximum allowable torque at a time when the swing motor is driven independently; a second valve device for generating a second output pressure corresponding to the correction value calculated by the controller; a second operation drive section included in the second regulator and to which the second output pressure is introduced for correcting the horsepower control starting pressure for securing the second allowable torque so as to be smaller by the second output pressure; and an output pressure corrector for limiting the first output pressure of the first valve device such that the first output pressure of the first valve device does not exceed the horsepower control starting pressure for securing the second allowable torque corrected by the second operation drive section.

As described above, since the hydraulic drive system includes the first valve device for generating the first output pressure to feed back the torque consumed by the second hydraulic pump to the first regulator based on the delivery pressure of the second hydraulic pump, and corrects the horsepower control starting pressure for securing the first allowable torque so as to be smaller by the first output pressure, it becomes possible to perform so-called horsepower control for controlling the sum of the torques consumed by the second hydraulic pump that drives the swing motor and the first hydraulic pump that drives the boom cylinder so as not to exceed the predetermined value.

Further, since the hydraulic drive system comprises a controller that, when the swing motor and the boom cylinder are driven simultaneously, calculates a correction value for the horsepower control starting pressure for reducing the second allowable torque of the second hydraulic pump so as to be smaller than a maximum allowable torque at a time when the swing motor is driven independently; a second valve device for generating a second output pressure corresponding to the correction value calculated by the controller; and a second operation drive section included in the second regulator and to which the second output pressure is introduced for correcting the horsepower control starting pressure for securing the second allowable torque so as to be smaller by the second output pressure, a distribution of torques between the first and second hydraulic pumps can be appropriately adjusted regardless of respective torque settings of the second hydraulic pump that drives the swing motor and the first hydraulic pump that drives the boom cylinder when the swing motor and the boom cylinder are driven independently of each other. This makes it possible to perform the boom raising speedily when the boom raising and the swinging are performed simultaneously, thereby realizing excellent combined operability.

On the other hand, since the maximum allowable torque of the second hydraulic pump can be set freely without being limited by a torque distribution at the time of a combined swing and boom raising operation, an optimum swing torque is obtained in an independent swing operation for increased swing operability.

Since the hydraulic drive system comprises the output pressure corrector for limiting the first output pressure of the first valve device such that the first output pressure of the first valve device does not exceed the horsepower control starting pressure for securing the second allowable torque corrected by the second operation drive section, even if the delivery pressure of the second hydraulic pump is lower than the limit of the output pressure corrector, the torque actually consumed by the second hydraulic pump that drives the swing motor is accurately fed back to the first hydraulic pump. Thus, the torque consumed by the first hydraulic pump does not be limited unnecessarily, and effective use of the output torque of the prime mover is realized.

Advantages of the Invention

According to the present invention, so-called horsepower control can be performed for controlling the sum of the torques consumed by the second hydraulic pump that drives the swing motor and the first hydraulic pump that drives the boom cylinder so as not to exceed the predetermined value.

Furthermore, a distribution of torques between the first and second hydraulic pumps can be appropriately set regardless of respective torque settings of the second hydraulic pump that drives the swing motor and the first hydraulic pump that drives the boom cylinder when the swing motor and the boom cylinder are driven independently of each other, thereby realizing excellent combined operability.

On the other hand, maximum allowable torque of the second hydraulic pump can be set freely without being limited by a torque distribution at the time of a combined swing and boom raising operation. Thus, an optimum swing torque is obtained in an independent swing operation for increased swing operability.

Furthermore, since the torque actually consumed by the second hydraulic pump that drives the swing motor is accurately fed back to the hydraulic pump that drives the boom, the torque consumed by the first hydraulic pump does not be limited unnecessarily, and effective use of the output torque of the prime mover is realized.

MODES FOR CARRYING OUT THE INVENTION

Embodiments of the present invention will hereinafter be described below with reference to the drawings.

First Embodiment

A hydraulic drive system for a construction machine according to a first embodiment of the present invention will be described below with reference to FIGS. 1 through 8.

~Configuration~

Figure 1:
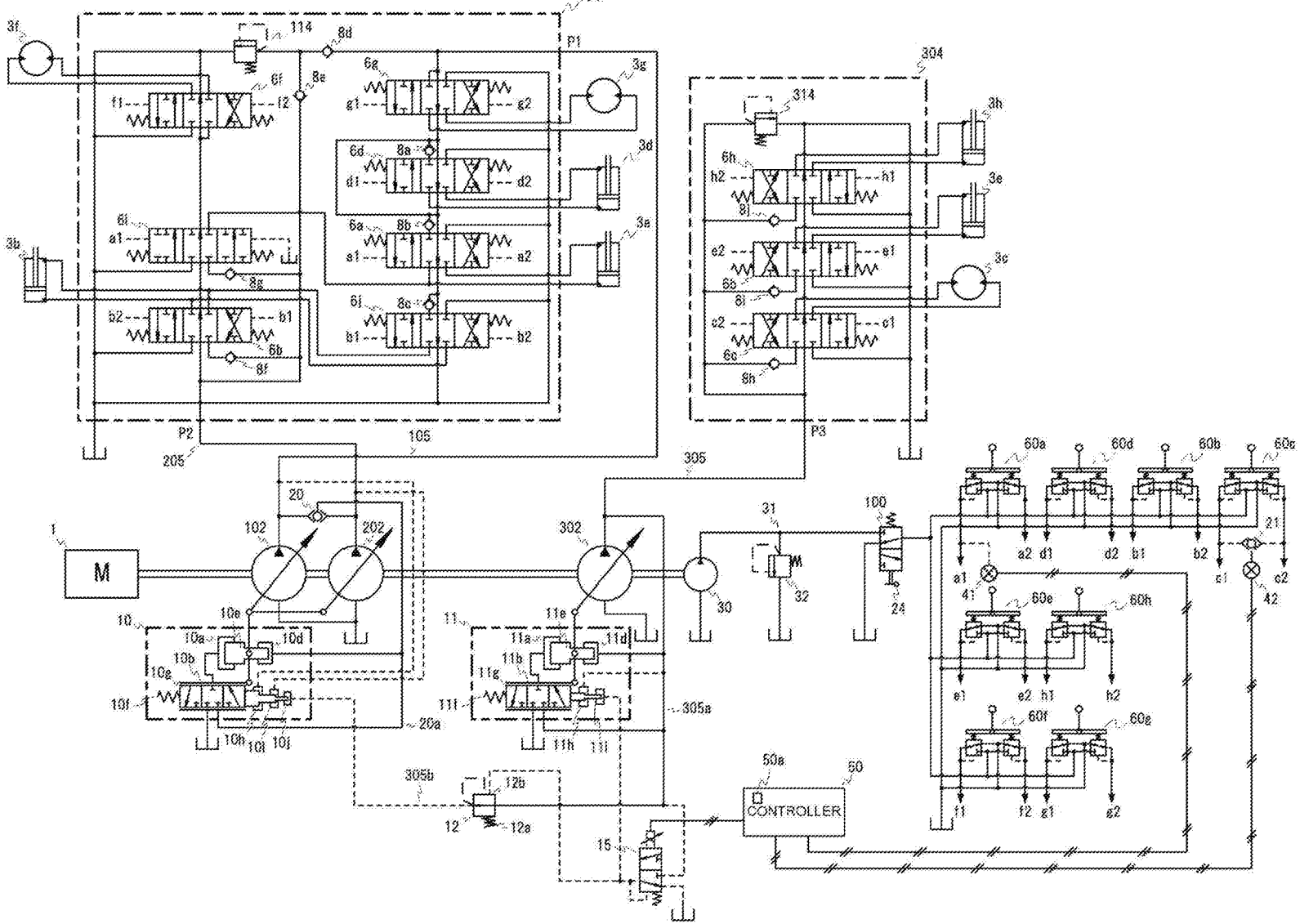
FIG. 1 is a diagram illustrating the configuration of a hydraulic drive system for a construction machine according to a first embodiment of the present invention.

FIG. 1 is a diagram illustrating the configuration of the hydraulic drive system for the construction machine according to the first embodiment of the present invention.

In FIG. 1, the hydraulic drive system according to the present embodiment includes a prime mover 1 (e.g., a diesel engine), variable-displacement main pumps 102 and 202 (first hydraulic pump) actuated by the prime mover 1, a variable-displacement main pump 302 (second hydraulic pump) actuated by the prime mover 1, a fixed-displacement pilot pump 30 actuated by the prime mover 1, a boom cylinder 3*a*, an arm cylinder 3*b*, a bucket cylinder 3*d*, and track motors 3*f* and 3*g* as a plurality of actuators actuated by a hydraulic fluid delivered from the variable-displacement main pumps 102 and 202, a swing motor 3*c*, a swing cylinder 3*e*, and a blade cylinder 3*h* as a plurality of actuators actuated by a hydraulic fluid delivered from the variable-displacement main pump 302, hydraulic fluid supply lines 105 and 205 for guiding a hydraulic fluid delivered from the variable-displacement main pumps 102 and 202 to the actuators 3*a*, 3*b*, 3*d*, 3*f*, and 3*g*, a hydraulic fluid supply line 305 for guiding a hydraulic fluid delivered from the variable-displacement main pump 302 to the actuators 3*c*, 3*e*, and 3*h*, a control valve block 104 connected to downstream portions of the hydraulic fluid supply lines 105 and 205 and to which a hydraulic fluid delivered from the variable-displacement main pumps 102 and 202 is introduced, a control valve block 304 connected to a downstream portion of the hydraulic fluid supply line 305 and to which a hydraulic fluid delivered from the variable-displacement main pump 302 is introduced, a common first regulator 10 associated with the variable-displacement main pumps 102 and 202 for controlling the displacement volumes of the main pumps 102 and 202 such that the torques consumed by the main pumps 102 and 202 does not exceed a first allowable torque (T12allw), and a second regulator 11 associated with the variable-displacement main pump 302 for controlling the displacement volume of the main pump 302 such that the torque consumed by the main pump 302 does not exceed a second allowable torque (T3allw).

The control valve block 104 includes a plurality of directional control valves 6*a*, 6*b*, 6*d*, 6*f*, 6*g*, 6*i*, and 6*j* for controlling the directions in and the speeds at which the actuators 3*a*, 3*b*, 3*d*, 3*f*, and 3*g* are driven, and a relief valve 114 connected to the downstream portions of the hydraulic fluid supply lines 105 and 205 respectively through check valves 8*d* and 8*e* for controlling the pressures of the hydraulic fluid supply lines 105 and 205 not to reach a preset pressure or higher. In the control valve block 104, a hydraulic fluid is introduced from the downstream portion of the hydraulic fluid supply line 205 to the directional control valves 6*b* and 6*i* respectively through check valves 8*f* and 8*g*, and a hydraulic fluid is introduced from the downstream portion of the hydraulic fluid supply line 105 to the directional control valves 6*d*, 6*a*, and 6*j* respectively through check valves 8*a*, 8*b*, and 8*c*.

The control valve block 304 includes a plurality of directional control valves 6*c*, 6*e*, and 6*h* for controlling the directions in and the speeds at which the actuators 3*c*, 3*e*, and 3*h* are driven, and a relief valve 314 connected to the downstream portions of the hydraulic fluid supply line 305 for controlling the pressure of the hydraulic fluid supply line 305 not to reach a preset pressure or higher. In the control valve block 304, a hydraulic fluid is introduced from the downstream portion of the hydraulic fluid supply line 305 to the directional control valves 6*c*, 6*e*, and 6*h* respectively through check valves 8*h*, 8*i*, and 8*j*.

The first regulator 10 has a differential piston 10*e* driven due to the difference between pressure receiving areas thereof and a tilting control valve 10*b*. The differential piston 10*e* has a larger-diameter pressure receiving chamber 10*a* selectively connectable to a hydraulic line 20*a* or a tank through the tilting control valve 10*b* and a smaller-diameter pressure receiving chamber 10*d* connected to the hydraulic line 20*a* at all times. The output pressure of a shuttle valve 20 that selects a higher one of the pressures of the hydraulic fluid supply lines 105 and 205 (delivery pressures of the main pumps 102 and 202) is introduced to the hydraulic line 20*a*.

When the larger-diameter pressure receiving chamber 10*a* is brought into fluid communication with the hydraulic line 20*a*, the differential piston 10*e* is shifted to the right in FIG. 1 due to the difference between its pressure receiving areas. When the larger-diameter pressure receiving chamber 10*a* is brought into fluid communication with the tank, the differential piston 10*e* is shifted to the left in FIG. 1 due to the force applied from the smaller-diameter pressure receiving chamber 10*d*. When the differential piston 10*e* is shifted to the right in FIG. 1, the tilting angles of the variable-displacement main pumps 102 and 202, i.e., the pump displacement volumes thereof, are reduced, reducing the flow rates of the hydraulic fluid delivered therefrom. When the differential piston 10*e* is shifted to the left in FIG. 1, the tilting angles of the variable-displacement main pumps 102 and 202, i.e., the pump displacement volumes thereof, are increased, increasing the flow rates of the hydraulic fluid delivered therefrom.

The tilting control valve 10*b* is an input torque limiting valve and is made up of a spool 10*g*, a spring 10*f*, and operation drive sections 10*h*, 10*i*, and 10*j*. The hydraulic fluid supply line 105 of the variable-displacement main pump 102 has its pressure P1 introduced to the operation drive section 10*h*, and the hydraulic fluid supply line 205 of the variable-displacement main pump 202 has its pressure P2 introduced to the operation drive section 10*i*. The hydraulic fluid supply line 305 of the variable-displacement main pump 302 has its pressure P3 sent through a hydraulic line 305*a* to a variable pressure reducing valve 12 (first valve device) and reduced by the variable pressure reducing valve 12. A reduced output pressure P3' (first output pressure) is introduced to a hydraulic line 305*b* and then introduced therethrough as a correction value for a horsepower control starting pressure for the first regulator 10 to the operation drive section 10*j* (hereinafter referred to as first operation drive section) of the tilting control valve 10*b*.

The spring 10*f* determines a maximum allowable torque T12allw_max for horsepower control for the first regulator 10 and determines a horsepower control starting pressure for securing the maximum allowable torque T12allw_max.

The variable pressure reducing valve 12 is a valve that, when the pressure in the hydraulic line 305*a* is equal to or higher than a certain value (set pressure) reduces the pressure in the hydraulic line 305*a* to that value, limiting the first output pressure P3', the value (set pressure) being variable. The variable pressure reducing valve 12 has a spring 12*a* for determining a set pressure at the time a combined operation for swinging and boom raising is not performed. The set pressure of the variable pressure reducing valve 12 determines a limiting pressure for the first output pressure P3' and the spring 12*a* determines a maximum limiting pressure therefor.

The variable pressure reducing valve 12 also has a pressure receiving section 12*b* (output pressure corrector) disposed opposite the spring 12*a*, for reducing the set pressure (limiting pressure) by an output pressure ΔP3 (second output pressure) that is introduced to the pressure receiving section 12*b* from a proportional solenoid valve 15 (second valve device). If the output pressure ΔP3 that is introduced from the proportional solenoid valve 15 to the pressure receiving section 12*b* is a tank pressure, then the set pressure of the variable pressure reducing valve 12 is of a maximum value determined by the spring 12*a*, and the limiting pressure is also maximum. As the output pressure ΔP3 that is introduced from the proportional solenoid valve 15 to the pressure receiving section 12*b* increases, the set pressure of the variable pressure reducing valve 12 is reduced and the limiting pressure also becomes lower.

The second regulator 11 has a differential piston 11*e* driven due to the difference between pressure receiving areas thereof and a tilting control valve lib. The differential piston 11*e* has a larger-diameter pressure receiving chamber 11*a* selectively connected to the hydraulic line 305*a* or the tank through the tilting control valve 11*b* and a smaller-diameter pressure receiving chamber 11*d* connected to the hydraulic line 305*a* at all times. The pressure P3 of the hydraulic fluid supply line 305 (delivery pressure of the main pump 302) is introduced to the hydraulic line 305*a*.

When the larger-diameter pressure receiving chamber 11*a* is brought into fluid communication with the hydraulic line 305*a*, the differential piston 11*e* is shifted to the right in FIG. 1 due to the difference between its pressure receiving areas. When the larger-diameter pressure receiving chamber 11*a* is brought into fluid communication with the tank, the differential piston 11*e* is shifted to the left in FIG. 1 due to the force applied from the smaller-diameter pressure receiving chamber 11*d*. When the differential piston 11*e* is shifted to the right in FIG. 1, the tilting angle of the variable-displacement main pump 302, i.e., the pump displacement volume thereof, is reduced, reducing the flow rate of the hydraulic fluid delivered therefrom. When the differential piston 11*e* is shifted to the left in FIG. 1, the tilting angle of the variable-displacement main pump 302, i.e., the pump displacement volume thereof, is increased, increasing the flow rate of the hydraulic fluid delivered therefrom.

The tilting control valve 11*b* is an input torque limiting valve and is made up of a spool 11*g*, a spring 11*f*, and operation drive sections 11*h* and 11*i*. The hydraulic fluid supply line 305 of the variable-displacement main pump 302 has its pressure P3 introduced to the operation drive section 11*h* through the hydraulic line 305*a*. The output pressure ΔP3 (second output pressure) from the proportional solenoid valve 15 is introduced as a correction value for a horsepower control starting pressure for the second regulator 11 to the operation drive section 11*i* (hereinafter referred to as second operation drive section) and is also introduced as a correction value for the limiting pressure to the pressure receiving section 12*b* of the variable pressure reducing valve 12.

The spring 11*f* determines a maximum allowable torque T3allw_max for horsepower control for the second regulator 11 and determines a horsepower control starting pressure (P3amax to be described later) for securing the maximum allowable torque T3allw_max.

The fixed-displacement pilot pump 30 has a hydraulic fluid supply line 31*a* to which there is connected a pilot relief valve 32 for keeping the pressure of the hydraulic fluid supply line 31*a* constant as a constant pilot primary pressure Ppi0 produced therefrom.

A pilot hydraulic line 31*b* is connected through a gate lock valve 100 to the hydraulic fluid supply line 31*a* downstream of the pilot relief valve 32. To pilot hydraulic line 31*b*, there are connected pairs of pilot valves (pressure reducing valves) disposed in a plurality of operation devices 60*a*, 60*b*, 60*c*, 60*d*, 60*e*, 60*f*, 60*g*, and 60*h*, respectively. The operation devices 60*a*, 60*b*, 60*c*, 60*d*, 60*e*, 60*f*, 60*g*, and 60*h* serve to command respective drives of the corresponding actuators 3*a* through 3*h*. When operating means such as operation levers or the like of the operation devices 60*a*, 60*b*, 60*c*, 60*d*, 60*e*, 60*f*, 60*g*, and 60*h* are operated, their pilot valves generate operation pressures a1 and a2, b1 and b2, c1 and c2, d1 and d2, e1 and e2, f1 and f2, g1 and g2, and h1 and h2 from a source pressure represented by the pilot primary pressure Ppi0 produced by the pilot relief valve 32. These operation signals are introduced to the corresponding directional control valves 6*a* through 6*j* to selectively shift them. When a gate lock lever 24 disposed at the operator seat of the hydraulic excavator (construction machine) is operated, the gate lock valve 100 is operated to selectively supply the pilot primary pressure Ppi0 produced by the pilot relief valve 32 to the pilot hydraulic line 31*b* (enable the operation devices 60*a* through 60*h*) or discharge the hydraulic fluid in the pilot hydraulic line 31*b* to the tank (disable the operation devices 60*a* through 60*h*).

The hydraulic drive system also includes a shuttle valve 21 for selecting and delivering a higher operation pressure ch of operation pressures c1 and c2 that are delivered from the pair of pilot valves of the operation device 60*c* for the swing motor 3*c*, among the plurality of operation devices, a pressure sensor 41 for detecting an operation pressure a1 for operating the boom cylinder 3*a* in a direction to extend (operation pressure for boom raising) of operation pressures a1 and a2 that are delivered from the pair of pilot valves of the operation device 60*a* for the boom cylinder 3*a*, and a pressure sensor 42 for detecting the higher operation pressure (swing operation pressure) ch delivered from the shuttle valve 21.

Outputs from the pressure sensors 41 and 42 are introduced to a controller 50, and an output from the controller 50 is introduced to the proportional solenoid valve 15. The pressure sensors 41 and 42 detect the operation pressure a1 and the operation pressure ch thereby to detect operated amounts of the operation levers of the operation devices 60*a* and 60*c*. The pressure sensors 41 and 42 may be replaced with potentiometers for directly detecting operated amounts of the operation levers of the operation devices 60*a* and 60*c*.

The pressure P3 of the hydraulic line 305*a* (pressure delivered from the main pump 302) is introduced to the proportional solenoid valve 15 as a source pressure from which the proportional solenoid valve 15 is to generate its output pressure.

~Torque Feedback Control~

Figure 3:
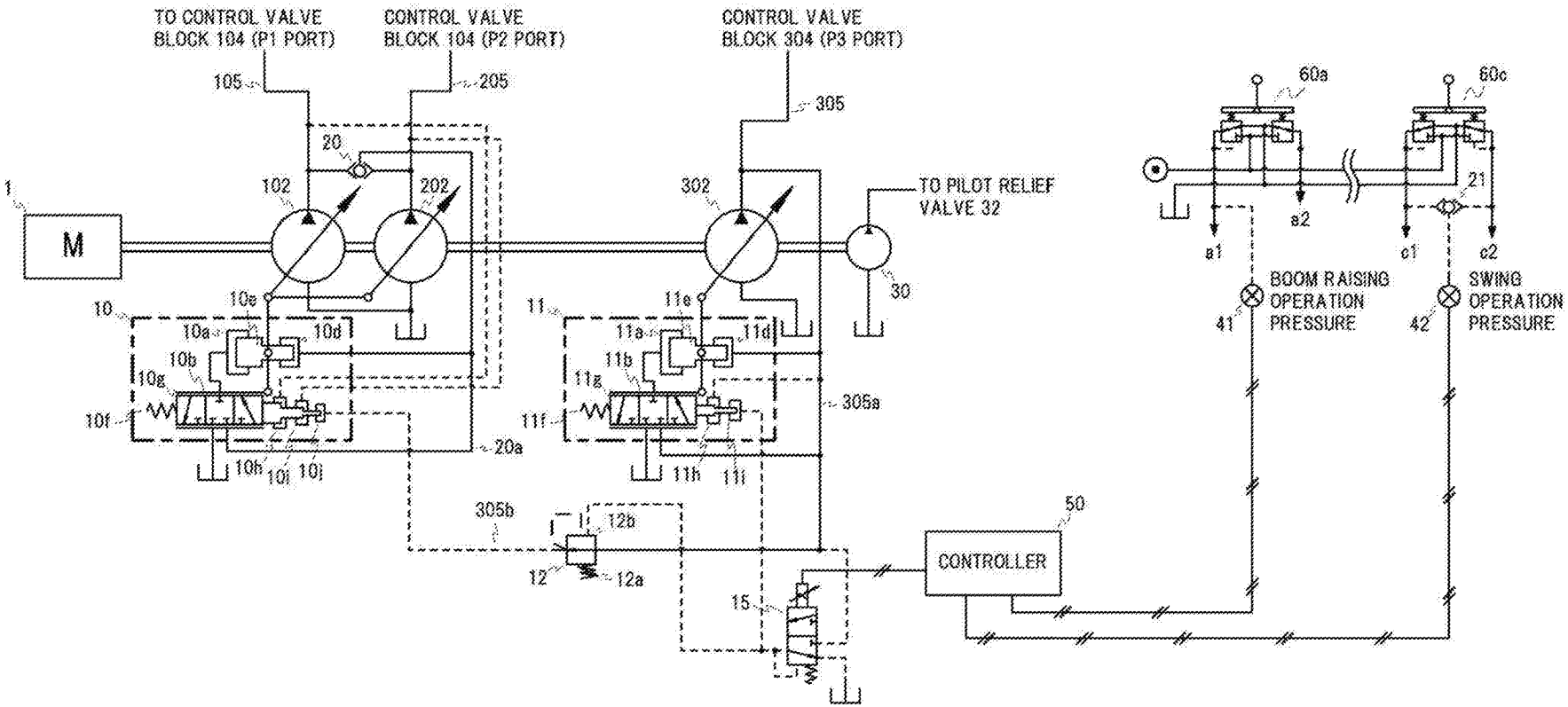
FIG. 3 is a hydraulic circuit diagram illustrating at an enlarged scale a pump periphery portion and a portion regarding torque feedback control in order to assist in an easy understanding of the torque feedback control in a combined operation for swinging and boom raising according to the present embodiment.

FIG. 3 is a hydraulic circuit diagram illustrating at an enlarged scale a pump periphery portion and a portion regarding torque feedback control in order to assist in an easy understanding of the torque feedback control in a combined operation for swinging and boom raising according to the present embodiment.

Figure 4:
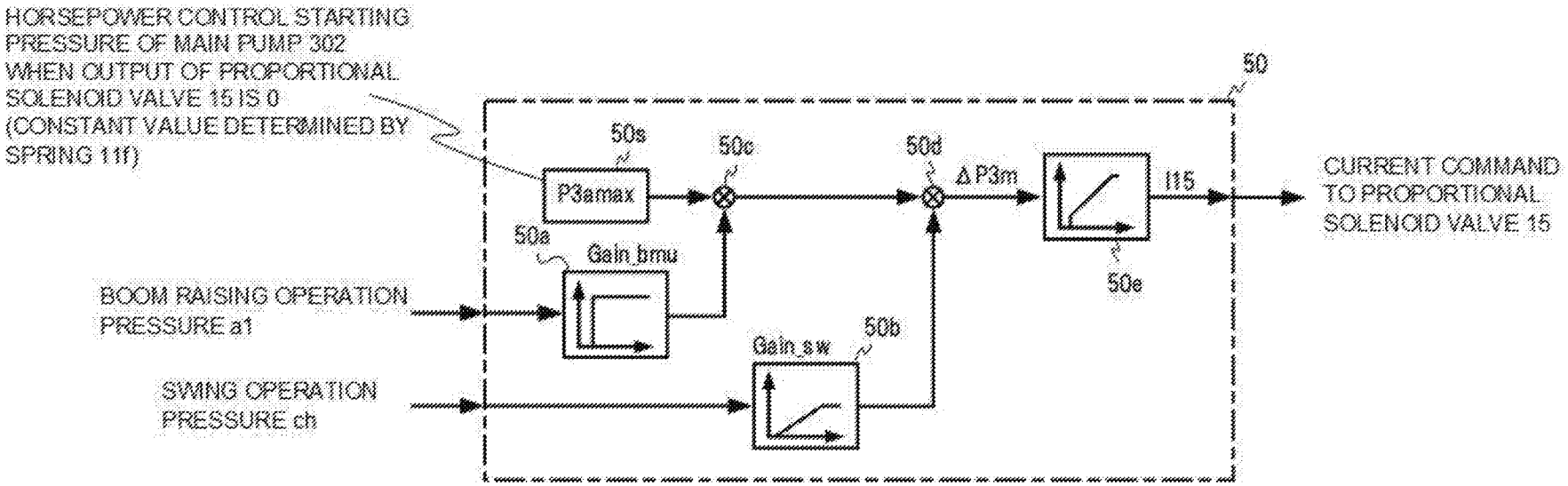
FIG. 4 is a functional block diagram illustrating a function regarding the torque feedback control that is performed by a CPU of a controller 50 according to the present embodiment.

FIG. 4 is a functional block diagram illustrating a function regarding the torque feedback control that is performed by a CPU 50*a* of the controller 50 according to the present embodiment.

In FIG. 4, the CPU 50*a* of the controller 50 has functions as a setting block 50*s*, a boom raising determining table 50*a*, a swing operation correction table 50*b*, multipliers 50*c* and 50*d*, and a current command calculating table 50*e*.

The setting block 50*s* has set therein a horsepower control starting pressure P3amax (see FIG. 8) for securing the maximum allowable torque T3allw_max for the second regulator 11 at the time when a combined operation for swinging and boom raising is not performed and the output pressure from the proportional solenoid valve 15 is 0.

The operation pressure a1 for boom raising and the swing operation pressure ch that are detected respectively by the pressure sensors 41 and 42 are input respectively to the tables 50*a* and 50*b*.

Figure 5A:
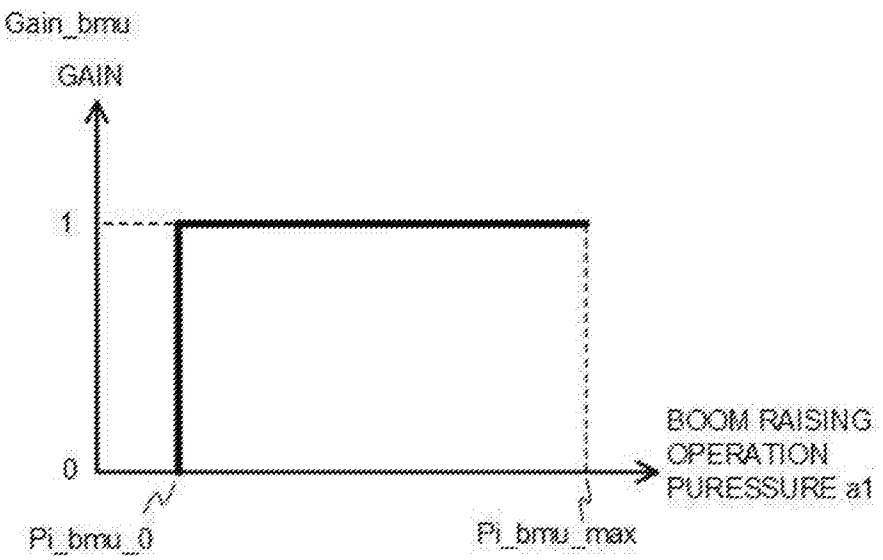
FIG. 5A is a diagram illustrating details of a boom raising determining table.
Figure 5B:
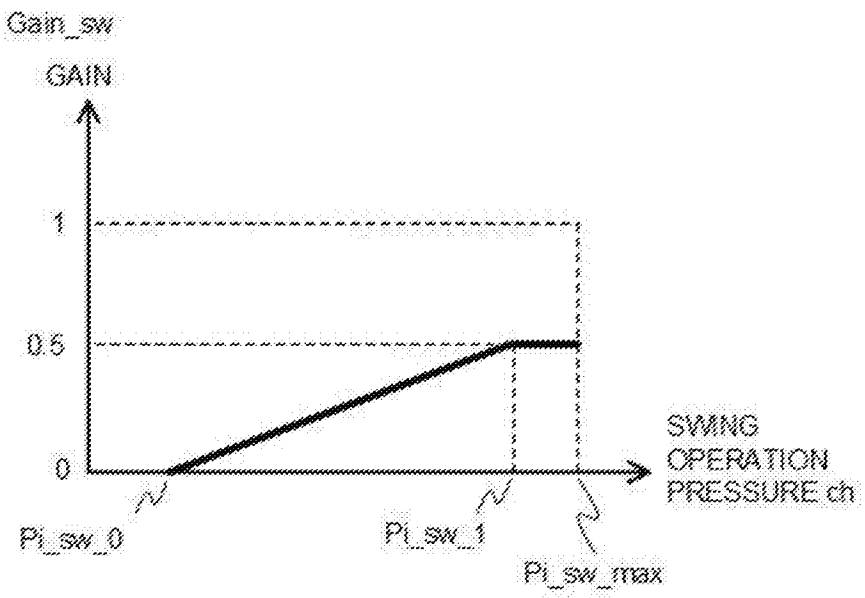
FIG. 5B is a diagram illustrating details of a swing operation correction table.

FIGS. 5A and 5B are diagrams illustrating details of the tables 50*a* and 50*b*.

In FIG. 5A, the table 50*a* has set therein characteristics in which when the operation pressure a1 for boom raising is higher than a minimum pressure Pi_bmu_0 in excess of a dead zone, a gain Gain_bmu according to boom raising operation increases from 0 to 1.

In FIG. 5B, the table 50*b* has set therein characteristics in which when the swing operation pressure ch is higher than a minimum pressure Pi_sw_0 in excess of a dead zone, a gain Gain_sw according to swing operation starts to increase from 0, and when the swing operation pressure ch increases up to a pressure Pi_sw_1 immediately prior to a maximum pressure Pi_sw_max, the gain Gain_sw becomes 0.5.

The multiplier 50*c* multiplies the horsepower control starting pressure P3amax set in the setting block 50*s* by the gain Gain_bmu according to boom raising operation that is output from the table 50*a*. The multiplier 50*d* then multiplies the product from the multiplier 50*c* by the gain Gain_sw according to swing operation that is output from the table 50*b*. The product from the multiplier 50*d* is computed as a correction value ΔP3*m* for a horsepower control starting pressure P3*a* for the second regulator 11.

The correction value ΔP3*m* computed by the multiplier 50*d* is input to the table 50*e*, which converts the correction value ΔP3*m* into a current command 115 for driving the proportional solenoid valve 15, and the controller 50 then outputs a corresponding current. The proportional solenoid valve 15 is actuated by the output current to produce the output pressure ΔP3 (second output pressure) corresponding to the correction value ΔP3*m*.

A torque feedback behavior in a combined operation for swinging and boom raising according to the present embodiment will be described below with reference to FIGS. 6A and 6B.

Figure 6A:
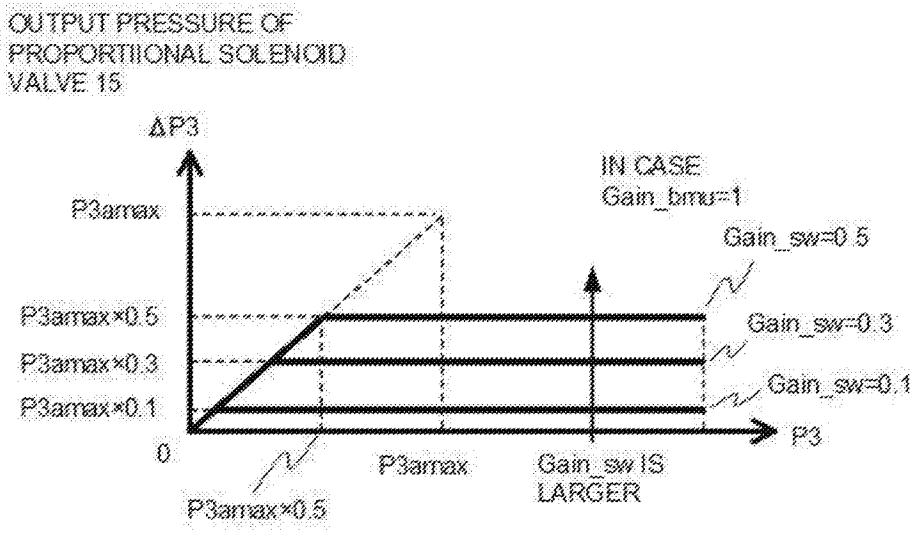
FIG. 6A is a diagram illustrating changes in an output pressure (second output pressure) of a proportional solenoid valve controlled by the controller.

FIG. 6A is a diagram illustrating changes in the output pressure ΔP3 (second output pressure) of the proportional solenoid valve 15 controlled by the controller 50. As illustrated in FIG. 6A, when a combined operation for swinging and boom raising is performed and the gain Gain_bmu according to boom raising operation is Gain_bmu=1, the output pressure ΔP3 is of a value that is larger as the gain Gain_sw according to swing operation is larger. Since the maximum value of the gain Gain_sw according to swing operation is 0.5, the output pressure ΔP3 does not be larger than the horsepower control starting pressure P3amax×0.5 (one half of the horsepower control starting pressure P3amax). The output pressure ΔP3 of the proportional solenoid valve 15 is introduced as a correction value for the horsepower control starting pressure P3*a* for the second regulator 11 to the second operation drive section 11*i* of the tilting control valve 11*b*.

Figure 6B:
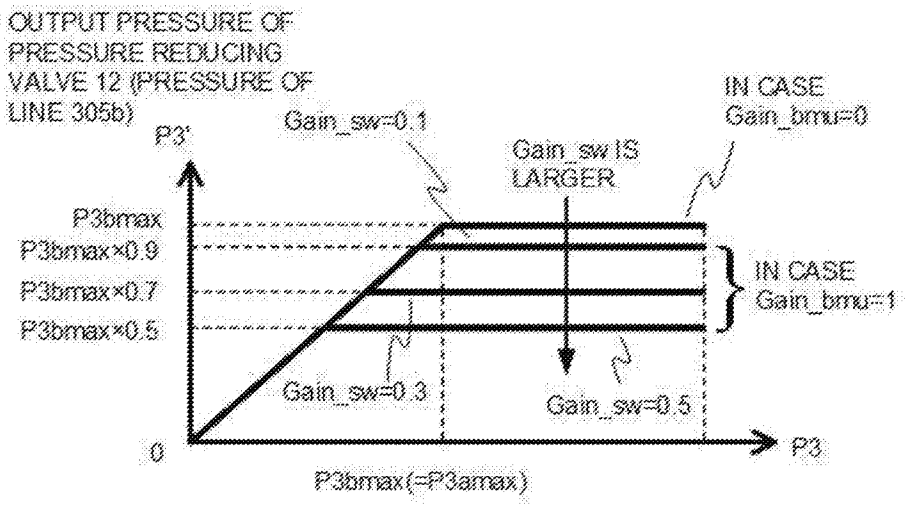
FIG. 6B is a diagram illustrating output characteristics of a variable pressure reducing valve.

FIG. 6B is a diagram illustrating output characteristics of the variable pressure reducing valve 12. When a combined operation for swinging and boom raising is not performed and the gain Gain_bmu according to boom raising operation is Gain_bmu=0, the output pressure P3' (first output pressure) of the variable pressure reducing valve 12 increases at a gradient of 1 in a range of 0<P3<P3bmax. P3bmax indicates the set pressure of the spring 12*a* of the variable pressure reducing valve 12, and a maximum limiting pressure of the variable pressure reducing valve 12. When the pressure P3 of the hydraulic fluid supply line 305 (delivery pressure of the main pump 302) is higher than the set pressure P3bmax of the spring 12*a* of the variable pressure reducing valve 12, the output pressure P3' of the variable pressure reducing valve 12 is limited to the set pressure P3bmax.

As described above, the output pressure ΔP3, illustrated in FIG. 6A, of the proportional solenoid valve 15 is introduced as a correction value for the limiting pressure P3*b* of the variable pressure reducing valve 12 to the pressure receiving section 12*b* of the variable pressure reducing valve 12. When a combined operation for swinging and boom raising is performed and the gain Gain_bmu according to boom raising operation is Gain_bmu=1, the larger the gain Gain_sw according to swing operation, the smaller the set pressure P3*b* of the variable pressure reducing valve 12. When the gain Gain_sw becomes 0.5, the set pressure P3*b* becomes the set pressure P3bmax of the spring 12*a*×0.5, i.e., one half of the set pressure P3bmax of the spring 12*a*. Therefore, when the pressure P3 of the hydraulic fluid supply line 305 (delivery pressure of the main pump 302) is higher than the limiting pressure P3*b* of the variable pressure reducing valve 12, the larger the gain Gain_sw according to swing operation, the smaller the output pressure P3' of the variable pressure reducing valve 12. When the gain Gain_sw becomes 0.5, the output pressure P3' is limited to one half of the set pressure P3bmax of the spring 12*a*. The output pressure P3' of the variable pressure reducing valve 12 is introduced as a correction value for the horsepower control starting pressure for the first regulator 10 to the first operation drive section 10*j* of the tilting control valve 10*b*.

Characteristics of allowable torques of the variable-displacement main pumps 102, 202, and 302 and characteristics of the torque consumed by the main pump 302 will be described below with reference to FIGS. 7A, 7B, and 7C.

Figure 7A:
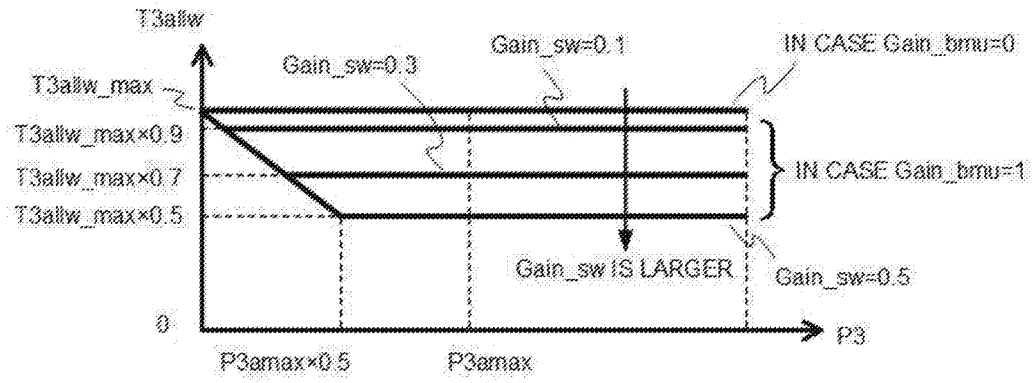
FIG. 7A is a diagram illustrating characteristics of an allowable torque T3allw (second allowable torque) of a variable-displacement main pump (second hydraulic pump).

FIG. 7A is a diagram illustrating characteristics of the allowable torque T3allw (second allowable torque) of the variable-displacement main pump 302.

In FIG. 7A, T3allw_max represents a maximum allowable torque of the main pump 302 that is determined by the spring 11*f*. When a combined operation for swinging and boom raising is performed and the gain Gain_bmu according to boom raising operation is Gain_bmu=1, the allowable torque T3allw of the main pump 302 is smaller than the maximum allowable torque T3allw_max, and the larger the gain Gain_sw according to swing operation, the smaller the allowable torque T3allw. At this time, the allowable torque T3allw is reduced to T3allw_max×0.5.

Figure 7B:
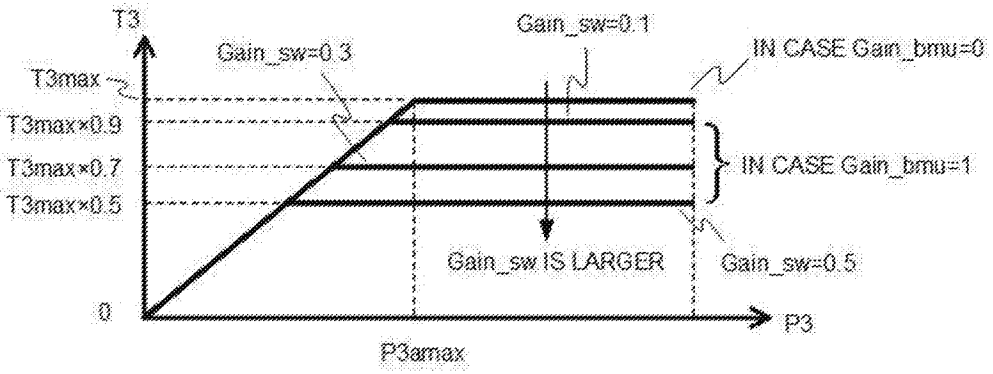
FIG. 7B is a diagram illustrating characteristics of a torque T3 that is actually consumed by the variable-displacement main pump (second hydraulic pump).

FIG. 7B is a diagram illustrating characteristics of a torque T3 that is actually consumed by the variable-displacement main pump 302.

In FIG. 7B. T3max represents a maximum torque consumed by the main pump 302 that is determined by the maximum allowable torque T3allw_max of the main pump 302. When a combined operation for swinging and boom raising is not performed and the gain Gain_bmu according to boom raising operation is Gain_bmu=0, the torque T3 that is actually consumed by the main pump 302 increases linearly in a range of 0<P3*a*<P3amax. As illustrated in FIG. 7A, when a combined operation for swinging and boom raising is performed and the gain Gain_bmu according to boom raising operation is Gain_bmu=1, since the allowable torque T3allw of the main pump 302 is smaller than the maximum allowable torque T3allw_max, the torque T3 that is actually consumed by the main pump 302 is smaller than the maximum consumed torque T3max. Furthermore, as illustrated in FIG. 7A, since the larger the gain Gain_sw according to swing operation, the smaller the allowable torque T3allw, the torque T3 that is actually consumed by the main pump 302 is limited by the allowable torque T3allw thereof, and as illustrated in FIG. 7B, the larger the gain Gain_sw according to swing operation, the smaller the torque T3. At this time, the torque T3 is reduced to T3max×0.5 in a manner corresponding to T3allw_max×0.5.

Figure 7C:
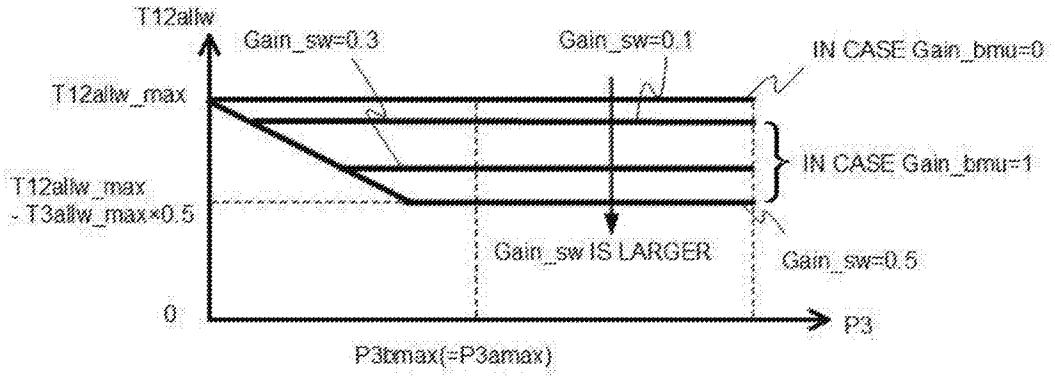
FIG. 7C is a diagram illustrating characteristics of an allowable torque T12allw (first allowable torque) of a variable-displacement main pump (first hydraulic pump).

FIG. 7C is a diagram illustrating characteristics of the allowable torque T12allw (first allowable torque) of the variable-displacement main pumps 102 and 202.

The torque T3 that is consumed by the variable-displacement main pump 302 is introduced as the output pressure P3' (first output pressure) of the variable pressure reducing valve 12 whose characteristics are illustrated in FIG. 6B to the first operation drive section 10*j* of the tilting control valve 10*b*, and fed back to the first regulator 10. Therefore, the allowable torque T12allw of the main pumps 102 and 202 has the characteristics illustrated in FIG. 7C.

In FIG. 7C, T12allw_max represents a maximum allowable torque determined by the spring 10*f* of the first regulator 10, and represents a maximum allowable torque value of the main pumps 102 and 202 in a case in which each of the operation devices of the actuators driven by the variable-displacement main pump 302 is in a neutral operated position.

As illustrated in FIG. 7C, when a combined operation for swinging and boom raising is not performed and the gain Gain_bmu according to boom raising operation is Gain_bmu=0, the allowable torque T12allw of the main pumps 102 and 202 is the maximum allowable torque T12allw_max. When a combined operation for swinging and boom raising is performed and the gain Gain_bmu according to boom raising operation is Gain_bmu=1, the allowable torque T12allw of the main pumps 102 and 202 is of a value smaller than the maximum allowable torque T12allw_max, obtained by subtracting the torque T3 consumed by the main pump 302 from the maximum allowable torque T12allw_max. Furthermore, since the larger the gain Gain_sw according to swing operation, the smaller the torque T3 consumed by the main pump 302, the larger the gain Gain_sw according to swing operation, also the smaller the allowable torque T12allw of the main pumps 102 and 202. At this time, in a manner corresponding to the allowable torque of the main pump 302 being reduced to T3allw_max×0.5 (or the torque consumed by the main pump 302 being reduced to T3max×0.5) the allowable torque T12allw of the main pumps 102 and 202 is reduced to a value obtained by subtracting one half of the maximum allowable torque T3allw_max of the main pump 302 from the maximum allowable torque T12allw_max (T12allw_max−T3allw_max×0.5) or a value obtained by subtracting one half of the maximum torque T3max consumed by the main pump 302 from the maximum allowable torque T12allw_max (T12allw_max−T3max×0.5).

Figure 8:
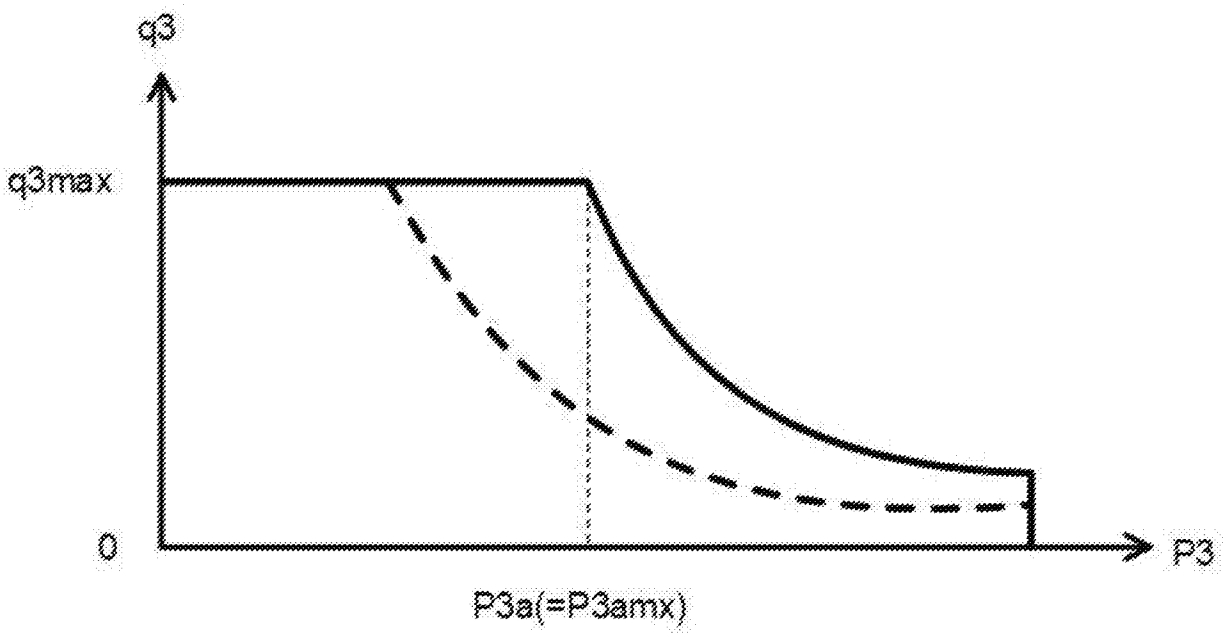
FIG. 8 is a diagram illustrating characteristics (PQ characteristics) of the delivery pressure and displacement volume of the variable-displacement main pump (second hydraulic pump).

FIG. 8 is a diagram illustrating characteristics, i.e., PQ characteristics, of the delivery pressure and displacement volume of the variable-displacement main pump 302. As illustrated in FIG. 8, the variable-displacement main pump 302 is of such characteristics that it keeps a maximum displacement volume q3max when the delivery pressure P3 is smaller than the horsepower control starting pressure P3*a*, and has its displacement volume reduced such that the torque consumed by the main pump 302 does not exceed the allowable torque T3allw when the delivery pressure P3 is equal to or larger than the horsepower control starting pressure P3*a*.

According to the present embodiment, inasmuch as the horsepower control starting pressure P3*a* is variable and the output pressure of the proportional solenoid valve 15 is 0 when a combined operation for swinging and boom raising is not performed, the horsepower control starting pressure P3*a* is of a constant value P3amax determined by the spring 11*f* of the second regulator 11. When a combined operation for swinging and boom raising is performed, as indicated by the broken-line curve in FIG. 8, the horsepower control starting pressure P3*a* is reduced to one half of P3amax because of the output pressure of the proportional solenoid valve 15. As a result, when a combined operation for swinging and boom raising is not performed, the allowable torque of the main pump 302 is maximum (T3allw_max), and when a combined operation for swinging and boom raising is performed, the allowable torque T3allw of the main pump 302 is reduced to one half of the maximum allowable torque T3allw_max.

~Correspondence to the Scope of Claims~

The variable pressure reducing valve 12 serves as a first valve device that generates the first output pressure P3' to feed back the torque consumed by the main pump 302 to the first regulator 10 based on the delivery pressure of the main pump 302.

The first regulator 10 includes a first operation drive section 10*j* to which the first output pressure P3' is introduced, and with the first operation drive section 10*j*, the first regulator 10 corrects the horsepower control starting pressure for securing the first allowable torque T12allw so as to be smaller by the first output pressure P3' thereby to control the displacement volumes of the main pumps 102 and 202 (first hydraulic pump) such that the sum of the torques consumed by the main pumps 101 and 202 (first hydraulic pump) and the main pump 302 (second hydraulic pump) does not exceed the predetermined value T12allw_max.

The controller 50 serves as a controller that, when the swing motor 3*c* and the boom cylinder 3*a* are driven simultaneously, calculates the correction value ΔP3*m* for the horsepower control starting pressure for reducing the second allowable torque T3allw of the main pumps 101 and 202 (second hydraulic pump) so as to be smaller than the maximum allowable torque T3allw_max at the time when the swing motor 3*c* is driven independently.

The proportional solenoid valve 15 serves as a second valve device for generating the second output pressure ΔP3 corresponding to the above correction value ΔP3*m* calculated by the controller 50.

The second operation drive section 11*i* is included in the second regulator 11 and to which the second output pressure ΔP3 is introduced for correcting the horsepower control starting pressure P3*a* for securing the second allowable torque T3allw so as to be smaller by the second output pressure ΔP3.

The pressure receiving section 12*b* of the variable pressure reducing valve 12 serves as an output pressure corrector for limiting the output pressure P3' (first output pressure) of the variable pressure reducing valve 12 (first valve device) such that the output pressure P3' (first output pressure) of the variable pressure reducing valve 12 (first valve device) does not exceed the horsepower control starting pressure P3*a* for securing the second allowable torque T3allw corrected by the second operation drive section 11*i*.

~Hydraulic excavator (construction machine)~

Figure 2:
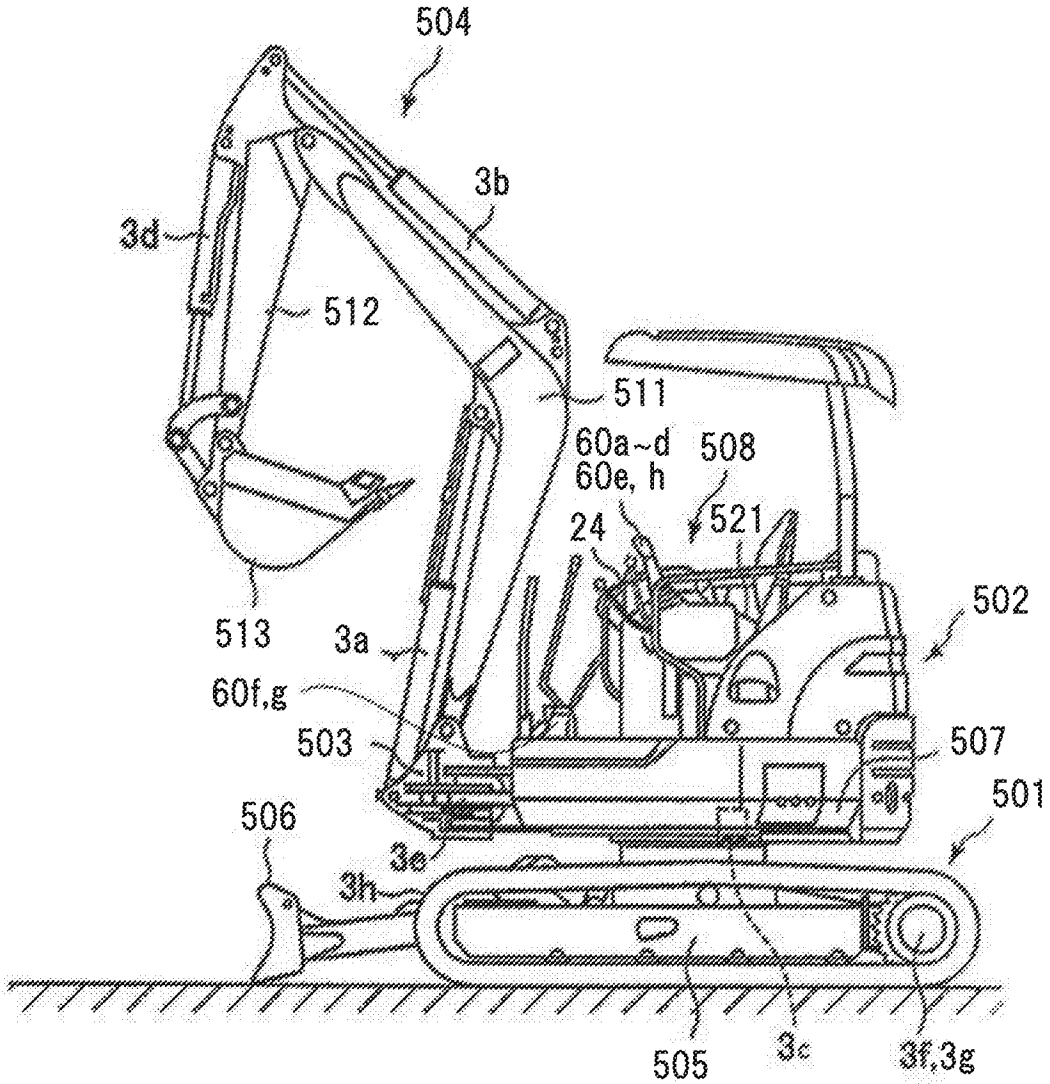
FIG. 2 is a view illustrating the appearance of a hydraulic excavator incorporating the hydraulic drive system according to the present embodiment.

FIG. 2 is a view illustrating the appearance of a hydraulic excavator incorporating the hydraulic drive system according to the present embodiment.

The hydraulic excavator includes a lower track structure 501, an upper swing structure 502, and a swingable front work implement 504. The front work implement 504 is made up of a boom 511, an arm 512, and a bucket 513. The upper swing structure 502 is swingable with respect to the lower track structure 501 by the swing motor 3*c*. A swing post 503 is mounted on a front portion of the upper swing structure, and the front work implement 504 is vertically movably attached to the swing post 503. The swing post 503 is horizontally angularly movable with respect to the upper swing structure 502 by the swing cylinder 3*e* as it extends and contracts. The boom 511, the arm 512, and the bucket 513 of the front work implement 504 are vertically angularly movable by the boom cylinder 3*a*, the arm cylinder 3*b*, and the bucket cylinder 3*d* as they extend and contract. The lower track structure 501 includes a central frame 505 to which there is attached a blade 506 that is vertically movable by the blade cylinder 3*h* as it extends and contracts. The lower track structure 501 travels when left and right crawler belts thereof are actuated by the track motors 3*f* and 3*g* as they rotate.

An operation room 508 is installed on the upper swing structure 502. The operation room 508 houses therein the operator seat 521, the operation devices 60*a* through 60*d* for the boom cylinder 3*a*, the arm cylinder 3*b*, the bucket cylinder 3*d*, and the swing motor 3*c*, the operation device 60*e* for the swing cylinder 3*e*, the operation device 60*h* for the blade cylinder 3*h*, the operation devices 60*f* and 60*g* for the track motors 3*f* and 3*g*, and the gate lock lever 24.

~Operation~

Operation of the present embodiment will be described below with reference to FIGS. 1 through 6.

First, the hydraulic fluid delivered from the fixed-displacement pilot pump 30 that is driven by the prime mover 1 is supplied to the hydraulic fluid supply line 31*a*. The pilot relief valve 32, which is connected to the hydraulic fluid supply line 31*a*, generates the pilot primary pressure Ppi0 in the hydraulic fluid supply line 31*a*. When the gate lock lever 24 is operated to shift the gate lock valve 100 from the illustrated position, the pilot primary pressure Ppi0 is supplied to the hydraulic fluid supply line 31*b*.

(a) When the Operation Levers of all the Operation Devices are Neutral.

As all the operation levers of the operation devices 60*a* through 60*h* are neutral, all the directional control valves 6*a*, 6*b*, 6*c*, 6*d*, 6*e*, 6*f*, 6*g*, 6*h*, 6*i*, and 6*j* are in their neutral positions. The hydraulic fluid delivered from the variable-displacement main pumps 102, 202, and 302 flows through the hydraulic fluid supply lines 105, 205, and 305 and neutral circuits (central bypass hydraulic lines) of the directional control valves 6*a*, 6*b*, 6*c*, 6*d*, 6*e*, 6*f*, 6*g*, 6*h*, 6*i*, and 6*j*, and is discharged to the tank. Therefore, the pressures P1, P2, and P3 in the hydraulic fluid supply lines 105, 205, and 305 are kept low (as a tank pressure).

The pressure P3 in the hydraulic fluid supply line 305 is introduced through the hydraulic line 305*a* to the operation drive section 11*h* of the tilting control valve 11*b* and also to the variable pressure reducing valve 12. Since the pressure P3 is low, the pressure introduced to the operation drive section 11*h* and the pressure receiving section 12*b* of the variable pressure reducing valve 12 is also kept low.

Similarly, the pressures P1 and P2 in the hydraulic fluid supply lines 105 and 205 are introduced respectively to the operation drive sections 10*h* and 10*i* of the tilting control valve 10*b*. Since the pressures P1 and P2 are low, the pressures introduced to the operation drive sections 10*h* and 10*i* are also kept low.

As all the operation levers of the operation devices 60*a* through 60*h* are neutral, the boom raising operation pressure and the swing operation pressure that are detected by the pressure sensors 41 and 42 are the tank pressure.

As indicated by the function block diagram of the controller 50 illustrated in FIG. 4 and the characteristics of the tables 50*a* and 50*b* illustrated in FIGS. 5A and 5B, when the boom raising operation pressure and the swing operation pressure are the tank pressure, the gain Gain_bmu according to boom raising operation and the gain Gain_sw according to swing operation are 0, and the correction value ΔP3*m* computed by the multiplier 50*d* of the controller 50 is 0. Therefore, the current command 115 is also 0, and the output current supplied to the proportional solenoid valve 15 is 0.

The output pressure ΔP3 of the proportional solenoid valve 15 is introduced as a correction value for the horsepower control starting pressure P3*a* (second allowable torque) for the second regulator 11 to the second operation drive section 11*i* of the tilting control valve 11*b*, and also introduced as a correction value for the limiting pressure P3*b* to the pressure receiving section 12*b* of the variable pressure reducing valve 12. Since the output current based on the current command 115 given to the proportional solenoid valve 15 is 0, the output pressure ΔP3 of the proportional solenoid valve 15 is the tank pressure.

Consequently, because the tank pressure is introduced to the pressure receiving section 12*b* of the variable pressure reducing valve 12, the set pressure of the variable pressure reducing valve 12 is of the value P3bmax determined by the spring 12*a*, so that the pressure P3 in the hydraulic line 305*a* that is kept low as described above is introduced as it is to the hydraulic line 305*b*.

Inasmuch as the operation drive sections 10*h*, 10*i*, and 10*j* of the tilting control valve 10*b* are kept low in pressure, the spool 10*g* of the tilting control valve 10*b* is shifted to the right in FIG. 1 by the spring 10*f*, draining the hydraulic fluid from the larger-diameter pressure receiving chamber 10*a* of the differential piston 10*e* to the tank.

As the larger-diameter pressure receiving chamber 10*a* of the differential piston 10*e* is kept under the tank pressure, the differential piston 10*e* is shifted to the left in FIG. 1, keeping the displacement volumes of the variable-displacement main pumps 102 and 202 maximum.

Inasmuch as the operation drive sections 11*h* and 11*i* of the tilting control valve 11*b* are kept low in pressure, the spool 11*g* of the tilting control valve 11*b* is shifted to the right in FIG. 1 by the spring 11*f*, draining the hydraulic fluid from the larger-diameter pressure receiving chamber 11*a* of the differential piston 11*e* to the tank.

As the larger-diameter pressure receiving chamber 11*a* of the differential piston 11*e* is kept under the tank pressure, the differential piston 11*e* is shifted to the left in FIG. 1, keeping the displacement volume of the variable-displacement main pump 302 maximum.

(b) When a Boom Raising Operation is Performed.

The operation pressure a1 for boom raising is delivered from the boom raising pilot valve of the boom operation device 60*a*.

The operation pressure a1 for boom raising shifts the directional control valve 6*a* to the right in FIG. 1 and also shifts the directional control valve 6*i* to the right in FIG. 1.

The hydraulic fluid delivered from the variable-displacement main pump 102 is supplied through the hydraulic fluid supply line 105 and the directional control valve 6*a*, and the hydraulic fluid delivered from the variable-displacement main pump 202 is supplied through the hydraulic fluid supply line 205 and the directional control valve 6*i*, to the bottom-side compartment of the boom cylinder 3*a*, extending the rod of the boom cylinder 3*a*.

The pressures P1 and P2 in the hydraulic fluid supply lines 105 and 205 of the variable-displacement main pumps 102 and 202 vary depending on the magnitude of the load on the boom cylinder 3*a*.

On the other hand, the operation devices 60*c*, 60*e*, and 60*h* for operating the actuators 3*c*, 3*e*, and 3*h* that are driven by the variable-displacement main pump 302 are not operated. Therefore, as with the case (a) described above, the pressure P3 in the hydraulic fluid supply line 305 of the variable-displacement main pump 302 is kept low.

The pressure P3 in the hydraulic fluid supply line 305 of the variable-displacement main pump 302 is introduced through the hydraulic line 305*a* to the variable pressure reducing valve 12. When only the boom raising operation is performed, as described above, the pressure P3 is kept low.

The boom raising operation pressure and the swing operation pressure are detected respectively by the pressure sensors 41 and 42 and inputted to the controller 50.

The controller 50 computes the correction value ΔP3*m* for the horsepower control starting pressure P3*a* from the pressures detected respectively by the pressure sensors 41 and 42. When only the boom raising operation is performed, the gain Gain_sw according to swing operation is Gain_sw=0 from the characteristics of the table 50*b* illustrated in FIG. 5B, and the correction value ΔP3*m* is 0. Therefore, the current command 115 is also 0, and the output pressure ΔP3 of the proportional solenoid valve 15 is the tank pressure.

At this time, the set pressure (limiting pressure) of the variable pressure reducing valve 12 is of the value P3bmax determined by the spring 12*a*, as with the case (a) described above. Because the pressure P3 in the hydraulic line 305*a* that is kept low is introduced to the variable pressure reducing valve 12 as described above, the output pressure P3' of the variable pressure reducing valve 12 is P3' ≈0<P3bmax, and the pressure P3' that is kept low is introduced to the first operation drive section 10*j* of the tilting control valve 10*b*.

The pressures P1 and P2 in the respective hydraulic fluid supply lines 105 and 205 are introduced respectively to the operation drive sections 10*h* and 10*i* of the tilting control valve 10*b*.

As described above, the pressures P1 and P2 in the hydraulic fluid supply lines 105 and 205 vary depending on the load on the boom cylinder 3*a*. When the sum of the pressures P1 and P2 is smaller than the horsepower control starting pressure P3amax for securing the maximum allowable torque of the second regulator 11 that is determined by the spring 10*f* of the tilting control valve 10*b*, the spool 10*g* of the tilting control valve 10*b* is shifted to the right in FIG. 1 by the spring 10*f*, draining the hydraulic fluid from the larger-diameter pressure receiving chamber 10*a* of the differential piston 10*e* to the tank. The differential piston is shifted to the left in FIG. 1, increasing the tilt of the variable-displacement main pumps 102 and 202.

When the sum of the pressures P1 and P2 is larger than the horsepower control starting pressure P3amax for securing the maximum allowable torque of the second regulator 11 that is determined by the spring 10*f* of the tilting control valve 10*b*, the force tending to push the spool 10*g* to the left overcomes the force of the spring 10*f*, moving the spool 10*g* to the left in FIG. 1, thereby guiding the hydraulic fluid from the hydraulic line 20*a* to the larger-diameter pressure receiving chamber 10*a*. Since the pressure in the larger-diameter pressure receiving chamber 10*a* of the differential piston 10*e* and the pressure in the smaller-diameter pressure receiving chamber 10*d* thereof become equal to each other, the differential piston 10*e* is moved to the right in FIG. 1 due to the difference between the pressure receiving areas thereof, reducing the tilt of the variable-displacement main pumps 102 and 202. When the differential piston 10*e* is shifted to the right in FIG. 1, the tilting control valve 10*b* has its outer peripheral portion moved to the right in FIG. 1 in ganged relation to the differential piston 10*e*. When the pressure of the operation drive sections 10*h* and 10*i* and the force of the spring 10*f* are brought into equilibrium, the opening of the spool 10*g* of the tilting control valve 10*b* is closed again, stopping the differential piston 10*e* against movement.

In this manner, the tilting control valve 10*b* and the differential piston 10*e* operate for the first regulator 10 to control the flow rates of the hydraulic fluid delivered from the variable-displacement main pumps 102 and 202 such that the sum of the torques consumed by the variable-displacement main pumps 102 and 202 does not exceed the value predetermined by the spring 10*f* (maximum allowable torque T12allw_max), i.e., for the first regulator 10 to perform so-called horsepower control.

On the other hand, as both of the operation drive sections 11*h* and 11*i* of the tilting control valve 11*b* of the second regulator 11 are kept under the low pressure, the spool 11*g* of the tilting control valve 11*b* is shifted to the right in FIG. 1 by the spring 11*f*, draining the hydraulic fluid from the larger-diameter pressure receiving chamber 11*a* of the differential piston 11*e* to the tank.

Since the larger-diameter pressure receiving chamber 11*a* of the differential piston 11*e* is kept under the tank pressure, the differential piston 11*e* is shifted to the left in FIG. 1, keeping the displacement volume of the variable-displacement main pump 302 maximum.

(c) When a Swing Operation is Performed.

The swing operation pressure ch (higher one of the operation pressures c1 and c2) is delivered from the pilot valve of the swing operation device 60*c*. Under the swing operation pressure ch, the directional control valve 6*c* is shifted to the left or the right in FIG. 1.

The hydraulic fluid delivered from the variable-displacement main pump 302 is supplied through the hydraulic fluid supply line 305 and the directional control valve 6*c* to the swing motor 3*c*, rotating the swing motor 3*c*. The pressure P3 in the hydraulic fluid supply line 305 of the variable-displacement main pump 302 varies depending on the magnitude of the load on the swing motor 3*c*.

On the other hand, since neither one of the operation levers of the operation devices 60*a*, 60*b*, 60*d*, 60*f*, and 60*g* for operating the actuators 3*a*, 3*b*, 3*d*, 3*f*, and 3*g* that are driven by the variable-displacement main pumps 102 and 202 is operated, the hydraulic fluid delivered from the variable-displacement main pumps 102 and 202 flows through the hydraulic fluid supply lines 105 and 205 and the directional control valves 6*a*, 6*b*, 6*d*, 6*f*, and 6*g*, and is discharged to the tank, as with the case (a) described above. The pressures P1 and P2 in the hydraulic fluid supply lines 105 and 205 are kept low.

The pressure P3 in the hydraulic fluid supply line 305 of the variable-displacement main pump 302 is introduced through the hydraulic line 305*a* to the variable pressure reducing valve 12. The boom raising operation pressure and the swing operation pressure are detected respectively by the pressure sensors 41 and 42 and inputted to the controller 50.

The controller 50 computes the correction value ΔP3*m* for the horsepower control starting pressure P3*a* from the pressures detected respectively by the pressure sensors 41 and 42. When only the swing operation is performed, the gain Gain_bmu according to boom raising operation is Gain_bmu=0 from the characteristics of the table 50*b* illustrated in FIG. 5A, and the correction value ΔP3*m* is 0. Therefore, the current command 115 is also 0, and the output pressure ΔP3 of the proportional solenoid valve 15 is the tank pressure.

At this time, the horsepower control starting pressure of the second regulator 11 is of the value P3amax determined by the spring 11*f*. When the pressure P3 in the hydraulic line 305*a* introduced to the operation drive section 11*h* is higher than the horsepower control starting pressure P3amax, the force tending to push the spool 11*g* to the left overcomes the force of the spring 11*f*, moving the spool 11*g* to the left in FIG. 1, thereby guiding the hydraulic fluid from the hydraulic line 305*a* to the larger-diameter pressure receiving chamber 11*a*. Since the pressure in the larger-diameter pressure receiving chamber 11*a* of the differential piston 11*e* and the pressure in the smaller-diameter pressure receiving chamber 11*d* thereof become equal to each other, the differential piston 11*e* is moved to the right in FIG. 1 due to the difference between the pressure receiving areas thereof, reducing the tilt of the variable-displacement main pump 302. When the differential piston 11*e* is shifted to the right in FIG. 1, the tilting control valve 11*b* has its outer peripheral portion moved to the right in FIG. 1 in ganged relation to the differential piston 11*e*. When the pressure of the operation drive section 11*h* and the force of the spring 11*f* are brought into equilibrium, the opening of the spool 11*g* of the tilting control valve 11*b* is closed again, stopping the differential piston 11*e* against movement.

With the differential piston 11*e* operating in this manner, the displacement volume q3 of the main pump 302 varies as indicated by the solid-line curve in FIG. 8. The variable-displacement main pump 302 performs so-called horsepower control for controlling the flow rate of the hydraulic fluid delivered thereby such that the torque does not exceed the torque value predetermined by the spring 11*f* (maximum allowable torque T3allw_max).

As the output pressure ΔP3 of the proportional solenoid valve 15 is the tank pressure, the set pressure (limiting pressure) of the variable pressure reducing valve 12 is of the value P3bmax determined by the spring 12*a*, as with the cases (a) and (b) described above. Therefore, the output pressure P3' of the variable pressure reducing valve 12 is of the characteristics in the case of Gain_bmu=0, as illustrated in FIG. 6B. When the pressure P3 in the hydraulic line 305*a* is in the range of 0<P3<P3bmax, the output pressure P3' is the same as the pressure P3 in the hydraulic line 305*a*. When the pressure P3 is in the range of P3 P3bmax, the pressure P3 in the hydraulic line 305*a* is limited to the set pressure P3bmax.

Since the output pressure P3' of the variable pressure reducing valve 12 is introduced to the first operation drive section 10*j* of the tilting control valve 10*b*, the allowable torque of the variable-displacement main pumps 102 and 202 is of the characteristics in the case of Gain_bmu=0 in FIG. 7C, and is of a value obtained by subtracting the torque T3 consumed by the variable-displacement main pump 302 illustrated in FIG. 7B from the maximum allowable torque T12allw_max of the variable-displacement main pumps 102 and 202.

The variable-displacement main pumps 102 and 202 deliver the hydraulic fluid such that the torque consumed thereby will be equal or smaller than the allowable torque T12allw_max. When only a swing operation is performed as described above, both of the hydraulic fluid supply lines 105 and 205 of the variable-displacement main pumps 102 and 202 are held under the low pressure, so that the variable-displacement main pumps 102 and 202 keep their maximum delivery flow rates.

(d) When a Swing Operation and a Boom Raising Operation are Performed Simultaneously.

The boom raising pilot valve of the operation device 60*a* for the boom delivers the boom raising operation pressure a1, and the pilot valve of the operation device 60*c* for swinging delivers the swing operation pressure ch (higher one of the operation pressures c1 and c2).

Under the boom raising operation pressure a1, the directional control valve 6*a* is shifted to the right in FIG. 1, and the directional control valve 6*i* is shifted to the right in FIG. 1. Under the swing operation pressure ch, the directional control valve 6*c* is shifted to the left or the right in FIG. 1.

The hydraulic fluid delivered from the variable-displacement main pump 102 is supplied through the hydraulic fluid supply line 105 and the directional control valve 6*a*, and the hydraulic fluid delivered from the variable-displacement main pump 202 is supplied through the hydraulic fluid supply line 205 and the directional control valve 6*i*, to the bottom-side compartment of the boom cylinder 3*a*, extending the rod of the boom cylinder 3*a*.

The pressures P1 and P2 in the hydraulic fluid supply lines 105 and 205 of the variable-displacement main pumps 102 and 202 vary depending on the magnitude of the load on the boom cylinder 3*a*.

The hydraulic fluid delivered from the variable-displacement main pump 302 is supplied through the hydraulic fluid supply line 305 and the directional control valve 6*c* to the swing motor 3*c*, rotating the swing motor 3*c*.

The pressure P3 in the hydraulic fluid supply line 305 of the variable-displacement main pump 302 varies depending on the magnitude of the load on the swing motor 3*c*.

The boom raising operation pressure and the swing operation pressure are detected respectively by the pressure sensors 41 and 42 and inputted to the controller 50.

The controller 50 computes the correction value ΔP3*m* for the horsepower control starting pressure P3*a* from the pressures detected respectively by the pressure sensors 41 and 42. When the boom raising operation and the swing operation are performed simultaneously, the boom raising operation gain Gain_bmu is Gain_bmu=1 and the swing operation gain Gain_sw is of a value between 0 and 0.5 depending on the swing operation pressure, from the characteristics of the tables 50*a* and 50*b* illustrated in FIG. 5. The correction value ΔP3*m* is calculated as a value obtained by multiplying the horsepower control starting pressure P3amax of the variable-displacement main pump 302 at the time the output pressure of the proportional solenoid valve 15 is 0 by Gain_bmu and Gain_sw. The correction value ΔP3*m* is converted into the current command 115, and a corresponding current is output to the proportional solenoid valve 15. The proportional solenoid valve 15 generates and delivers an output pressure ΔP3 corresponding to the correction value ΔP3*m*.

In other words, when the boom raising and the swinging are performed simultaneously, the output pressure ΔP3 of the proportional solenoid valve 15 is represented as ΔP3=P3amax×Gain_bmu×Gain_sw. Since the boom raising operation gain Gain_bmu is Gain_bmu=1 at all times, the output pressure ΔP3 is represented as ΔP3=P3amax× Gain_sw. Therefore, as illustrated in FIG. 6A, the output pressure ΔP3 is small when the swing operation pressure is small, and increases as the swing operation pressure increases.

The output pressure ΔP3 of the proportional solenoid valve 15 is introduced to the pressure receiving section 12*b* of the variable pressure reducing valve 12, reducing the set pressure of the variable pressure reducing valve 12 by the introduced pressure. As illustrated in FIG. 6B, the larger the swing operation gain Gain_sw, the output pressure P3' of the variable pressure reducing valve 12 is limited to a smaller value. When Gain_sw=0.5, the output pressure P3' of the variable pressure reducing valve 12 is limited to 0.5 times the set pressure P3bmax determined by the spring 12*a*.

Furthermore, the output pressure ΔP3 of the proportional solenoid valve 15 is introduced to the second operation drive section 11*i* of the tilting control valve 11*b* in the second regulator 11 of the variable-displacement main pump 302. The output pressure P3' of the variable pressure reducing valve 12 is introduced to the first operation drive section 10*j* of the tilting control valve 10*b* in the first regulator 10 of the variable-displacement main pumps 102 and 202.

As described above, since the second regulator 11 controls the displacement volume of the variable-displacement main pump 302 to bring the force of the spring 11*f* of the tilting control valve 11*b* and the pressures acting on the operation drive sections 11*h* and 11*i* into equilibrium, the output pressure ΔP3 of the proportional solenoid valve 15 that is introduced to the second operation drive section 11*i* acts in a direction to reduce the allowable torque T3allw of the variable-displacement main pump 302.

As illustrated in FIG. 7A, the larger the swing operation gain Gain_sw, the smaller the allowable torque T3allw of the variable-displacement main pump 302. When Gain_sw=0.5, the allowable torque T3allw of the variable-displacement main pump 302 is limited to 0.5 times the maximum allowable torque T3allw_max determined by the spring 11*f*.

At this time, the displacement volume q3 of the variable-displacement main pump 302 varies as indicated by the broken-line curve in FIG. 8. As illustrated in FIG. 7B, the larger the swing operation gain Gain_sw, the torque T3 actually consumed by the main pump 302 is limited to a smaller value. When Gain_sw=0.5, the torque T3 actually consumed by the main pump 302 is limited to 0.5 times the maximum torque T3max.

Similarly, the first regulator 10 controls the displacement volumes of the variable-displacement main pumps 102 and 202 to bring the force of the spring 10*f* of the tilting control valve 10*b* and the pressures acting on the operation drive sections 10*h*, 10*i*, and 10*j* into equilibrium. The first operation drive section 10*j* is originally provided to convert the torque of the variable-displacement main pump 302 into a pressure and feed back the pressure. By limiting the delivery pressure of the variable-displacement main pump 302 that is introduced to the first operation drive section 10*j*, with the variable pressure reducing valve 12, the allowable torque T12allw is reduced by the torque actually consumed by the variable-displacement main pump 302.

As described above, since the larger the swing operation torque Gain_sw, the torque T3 consumed by the variable-displacement main pump 302 is limited by a larger value, the allowable torque T12allw of the variable-displacement main pumps 102 and 202 is accordingly limited by a larger value, as illustrated in FIG. 7C.

When Gain_sw=0.5, in a manner corresponding to the allowable torque of the main pump 302 being reduced to T3allw_max×0.5 (or the torque consumed by the main pump 302 being reduced to T3max×0.5), the allowable torque T12allw of the variable-displacement main pumps 102 and 202 is reduced to a value obtained by subtracting one half of the maximum allowable torque T3allw_max of the main pump 302 from the maximum allowable torque T12allw_max (T12allw_max−T3allw_max×0.5) or a value obtained by subtracting one half of the maximum torque T3max consumed by the main pump 302 from the maximum allowable torque T12allw_max (T12allw_max−T3max×0.5).

In this fashion, when the swing motor 3*c* and the boom cylinder 3*a* are driven simultaneously, the allowable torque T3allw of the main pump 302 that drives the swing motor 3*c* is corrected so as to be reduced, making it possible to increase the allowable torque T12allw of the main pumps 102 and 202 that drive the boom cylinder 3*a* by the reduction in the torque consumed by the main pump 302 that drives the swing motor 3*c*. Consequently, even if the set torque T3allw_max of the main pump 302 that drives the swing motor 3*c* is originally large, a distribution of torques between the main pumps 102 and 202 and the main pump 302 is appropriately adjusted regardless of the respective torque settings T12allw_max and T3allw_max of the main pumps 102 and 202 and the main pump 302. When the boom raising and the swinging are performed simultaneously, the boom raising can be performed speedily, thereby realizing excellent combined operability.

If the load on the swing motor 3*c* is small and the delivery pressure P3 of the main pump 302 is lower than the set pressure of the variable pressure reducing valve 12, the output pressure P3' of the variable pressure reducing valve 12 is P3'=P3, and the torque actually consumed by the main pump 302 is accurately fed back to the main pumps 102 and 202, so that the allowable torque T12allw of the main pumps 102 and 202 does not be limited unnecessarily. This also allows the boom raising to be performed speedily, thereby realizing excellent combined operability and effective use of the output torque of the prime mover 1 when the boom raising and the swinging are performed simultaneously.

Moreover, when the boom raising and the swinging are performed simultaneously, the controller 50 calculates the correction value ΔP3*m* as a value that increases as the swing operation pressure ch increases. Therefore, when the swing operation is carried out after the boom raising operation, switching to simultaneously performing the boom raising and the swinging, the allowable torque of the main pump 302 and the allowable torque of the main pumps 102 and 202 are continuously adjusted depending on the swing operation amount, making it possible to perform a smooth swing and boom raising operation for excellent combined operability.

~Advantages~

The present embodiment offers the following advantages:

1. Since the flow rate of the hydraulic fluid delivered from the main pump 302 is controlled by only the delivery pressure of the main pump 302, the hydraulic fluid delivered from the main pump 302 flows at a stable flow rate without being affected by variations in the flow rates of the hydraulic fluid delivered from the main pumps 102 and 202. The swing motor 3*c* can thus be driven at a stable rotational speed.

2. The output pressure P3' of the variable pressure reducing valve 12 (first valve device) is fed back as the torque actually consumed by the main pump 302 to the first operation drive section 10*j* of the first regulator 10, and the horsepower control starting pressure for securing the allowable torque T12allw of the main pumps 102 and 202 is corrected so as to be reduced by the first output pressure P3'. Consequently, it is possible to perform so-called horsepower control for controlling the sum of the torques consumed by the main pump 302 that drive the swing motor and the main pumps 102 and 202 that drive the boom cylinder so as not to exceed the predetermined value T12allw_max.

3. When the swing motor 3*c* and the boom cylinder 3*a* are driven simultaneously, the allowable torque T3allw of the main pump 302 that drives the swing motor 3*c* is corrected so as to be reduced, making it possible to increase the allowable torque T12allw of the main pumps 102 and 202 that drive the boom cylinder 3*a* by the reduction in the torque consumed by the main pump 302 that drives the swing motor 3*c*. Consequently, even if the set torque T3allw_max of the main pump 302 that drives the swing motor 3*c* is originally large, a distribution of torques between the main pumps 102 and 202 and the main pump 302 is appropriately adjusted regardless of the respective torque settings T12allw_max and T3allw_max of the main pumps 102 and 202 and the main pump 302. When the boom raising and the swinging are performed simultaneously, the boom raising can be performed speedily, thereby realizing excellent combined operability.

4. When the swing motor 3*c* and the boom cylinder 3*a* are driven simultaneously, as described above, since the allowable torque T3allw of the main pump 302 that drives the swing motor 3*c* is corrected so as to be reduced, the maximum allowable torque T3allw_max of the main pump 302 can be set freely without being limited by a torque distribution at the time of a combined swing and boom raising operation. Thus, an optimum swing torque is obtained in an independent swing operation for increased swing operability.

5. When the load on the swing motor 3*c* is small and the delivery pressure P3 of the main pump 302 is lower than the set pressure of the variable pressure reducing valve 12, the output pressure P3' of the variable pressure reducing valve 12 is P3'=P3, and the torque actually consumed by the main pump 302 is accurately fed back to the main pumps 102 and 202, so that the allowable torque T12allw of the main pumps 102 and 202 does not be limited unnecessarily. This also allows the boom raising to be performed speedily, thereby realizing excellent combined operability and effective use of the output torque of the prime mover 1 when the boom raising and the swinging are performed simultaneously.

6. Moreover, when the boom raising and the swinging are performed simultaneously, the controller 50 calculates the correction value ΔP3*m* as a value that increases as the swing operation pressure ch increases. Therefore, when the swing operation is carried out after the boom raising operation, switching to simultaneously performing the boom raising and the swinging, the allowable torque of the main pump 302 and the allowable torque of the main pumps 102 and 202 are continuously adjusted depending on the swing operation amount, making it possible to perform a smooth swing and boom raising operation for excellent combined operability.

7. The output pressure ΔP3 of the proportional solenoid valve 15 is used in both a circuit portion for limiting the allowable torque T3allw of the main pump 302 that drives the swing motor and a circuit portion for feeding back the torque consumed by the main pump 302 that drives the swing motor to the main pumps 102 and 202 that drive the boom cylinder. Therefore, even in the event of an operation failure of the controller 50 that computes the correction value and the proportional solenoid valve 15 that outputs the hydraulic first correction value, the sum of the torques of the main pumps 102 and 202 for driving the boom cylinder and the main pump 302 for driving the swing motor does not exceed the predetermined value T12allw_max, so that the prime mover 1 is reliably prevented from stalling.

Second Embodiment

A hydraulic drive system for a construction machine according to a second embodiment of the present invention will be described below with reference to FIGS. 9 through 12C. The circuit arrangement of the hydraulic drive system according to the present embodiment is the same as that of the first embodiment illustrated in FIG. 1. According to the present embodiment, the controller 50 is replaced with a controller 50A.

Figure 9:
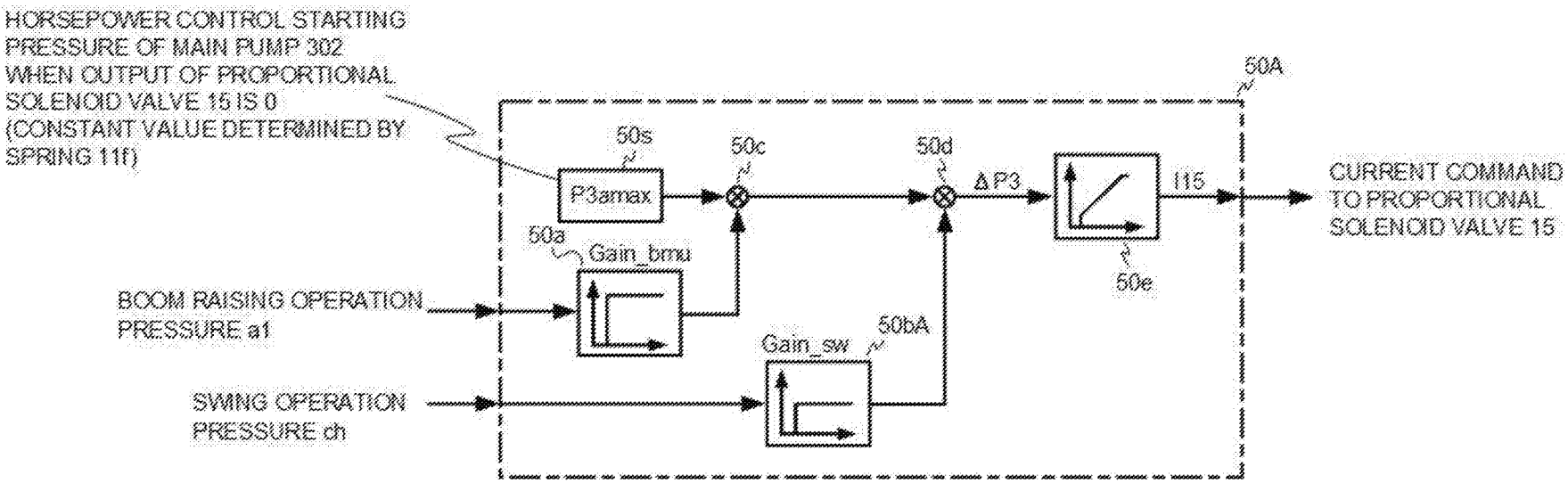
FIG. 9 is a functional block diagram illustrating a function relative to torque feedback control that is performed by a CPU of a controller according to a second embodiment of the present invention.

FIG. 9 is a functional block diagram illustrating a function regarding torque feedback control that is performed by a CPU 50*a* of the controller 50A according to the second embodiment of the present invention.

In FIG. 9, the function of the CPU 50*a* of the controller 50A is the same as the controller 50 according to the first embodiment except that the swing operation correction table 50*b* has changed to a swing operation correction table 50*b*A.

Figure 10:
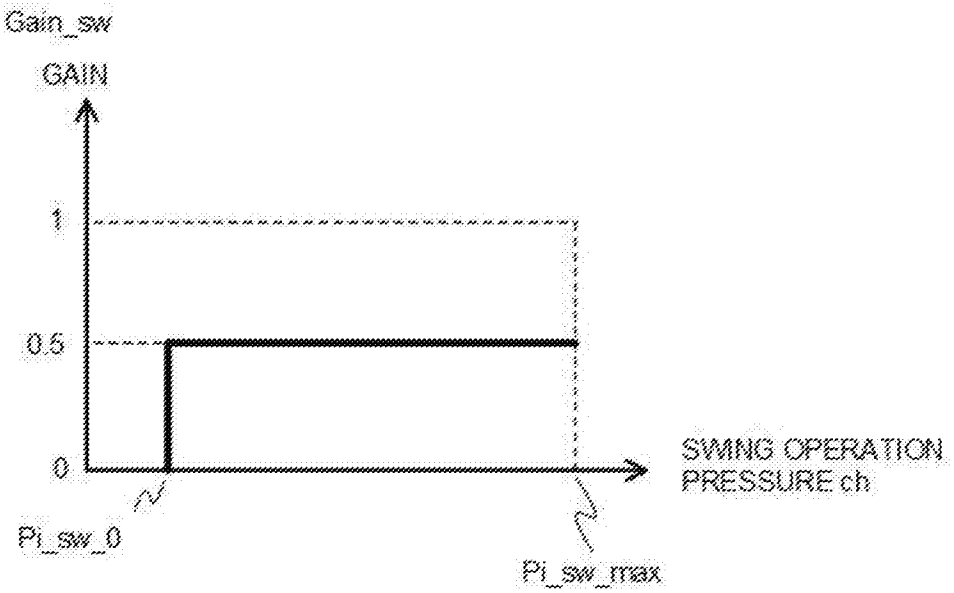
FIG. 10 is a diagram illustrating details of a swing operation correction table.

FIG. 10 is a diagram illustrating details of the swing operation correction table 50*b*A.

In FIG. 10, the table 50*b* has set therein characteristics in which when the swing operation pressure ch is higher than a minimum pressure Pi_sw_0 in excess of a dead zone, a gain Gain_sw according to swing operation increases stepwise from 0 to 0.5.

A torque feedback behavior in a combined operation for swinging and boom raising according to the present embodiment will be described below with reference to FIGS. 11A and 11B.

Figure 11A:
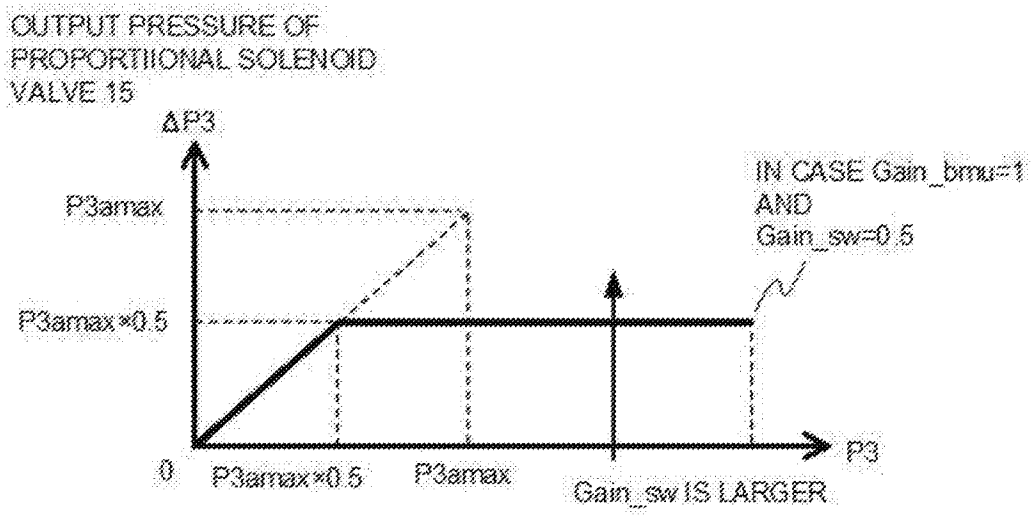
FIG. 11A is a diagram illustrating changes in an output pressure ΔP3 of a proportional solenoid valve controlled by the controller.

FIG. 11A is a diagram illustrating changes in the output pressure ΔP3 of the proportional solenoid valve 15 controlled by the controller 50A. As illustrated in FIG. 11A, when a combined operation for swinging and boom raising is performed and the gain Gain_bmu according to boom raising operation is Gain_bmu=1, since the gain Gain_sw according to swing operation is 0.5, the output pressure ΔP3 is limited to the horsepower control starting pressure P3amax×0.5 (one half of the horsepower control starting pressure P3amax) regardless of the magnitude of the swing operation pressure.

Figure 11B:
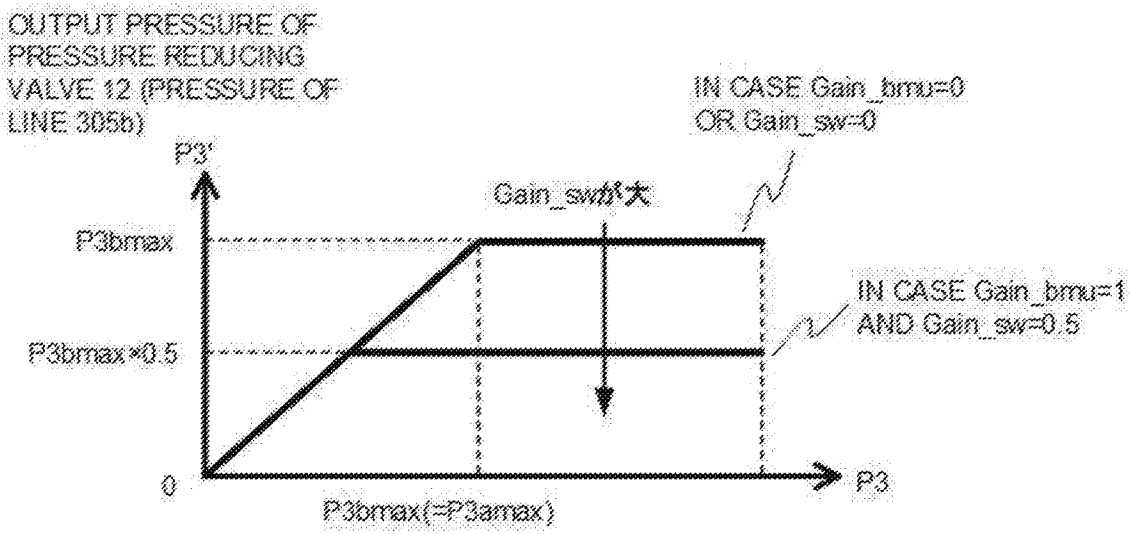
FIG. 11B is a diagram illustrating output characteristics of a variable pressure reducing valve.

FIG. 11B is a diagram illustrating output characteristics of the variable pressure reducing valve 12. Since the output pressure ΔP3 of the proportional solenoid valve 15 illustrated in FIG. 11A is introduced to the pressure receiving section 12*b* of the variable pressure reducing valve 12, as described above, when a combined operation for swinging and boom raising is performed and the gain Gain_bmu according to boom raising operation is Gain_bmu=1, the set pressure P3*b* of the variable pressure reducing valve 12 immediately becomes one half of the set pressure P3bmax of the spring 12*a*. Therefore, when the pressure P3 in the hydraulic fluid supply line 305 (delivery pressure of the main pump 302) is higher than the limiting pressure P3*b* of the variable pressure reducing valve 12, the output pressure P3' of the variable pressure reducing valve 12 is limited to one half of the set pressure P3bmax of the spring 12*a* regardless of the magnitude of the swing operation pressure.

Characteristics of allowable torques of the variable-displacement main pumps 102, 202, and 302 and characteristics of the torque consumed by the main pump 302 will be described below with reference to FIGS. 12A, 12B, and 12C.

Figure 12A:
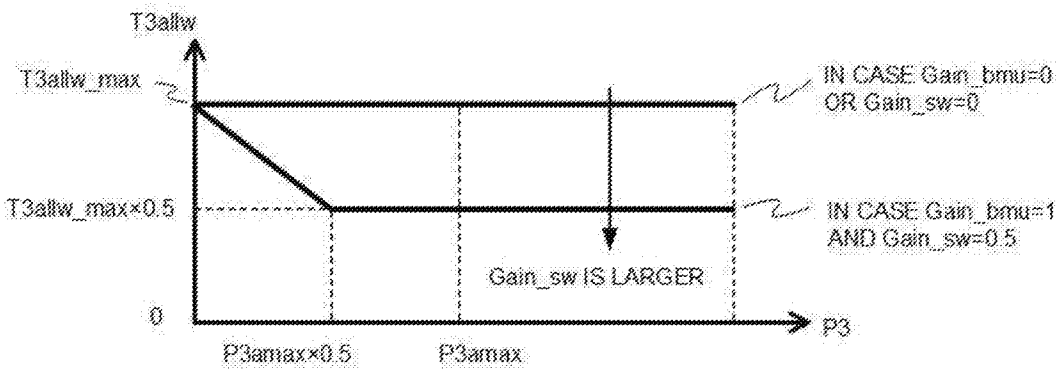
FIG. 12A is a diagram illustrating characteristics of an allowable torque T3allw of a variable-displacement main pump (second hydraulic pump).

FIG. 12A is a diagram illustrating characteristics of the allowable torque T3allw of the variable-displacement main pump 302. In FIG. 12A, when a combined operation for swinging and boom raising is performed and the gain Gain_bmu according to boom raising operation is Gain_bmu=1, the allowable torque T3allw of the main pump 302 becomes one half of the maximum allowable torque T3allw_max (T3allw_max×0.5).

Figure 12B:
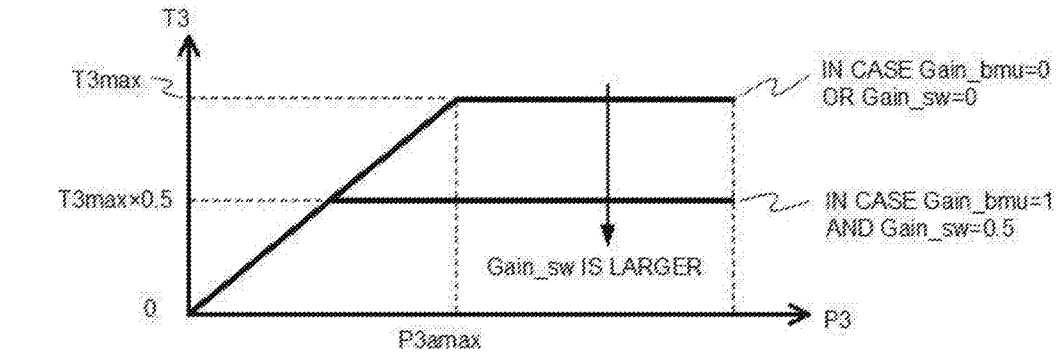
FIG. 12B is a diagram illustrating characteristics of a torque T3 that is actually consumed by the variable-displacement main pump (second hydraulic pump).

FIG. 12B is a diagram illustrating characteristics of the torque T3 that is actually consumed by the variable-displacement main pump 302. In FIG. 12B, when a combined operation for swinging and boom raising is performed and the gain Gain_bmu according to boom raising operation is Gain_bmu=1, since the allowable torque T3allw of the main pump 302 becomes one half of the maximum allowable torque T3allw_max, the torque T3 actually consumed by the main pump 302 becomes one half of the maximum consumed torque T3max (T3max×0.5).

Figure 12C:
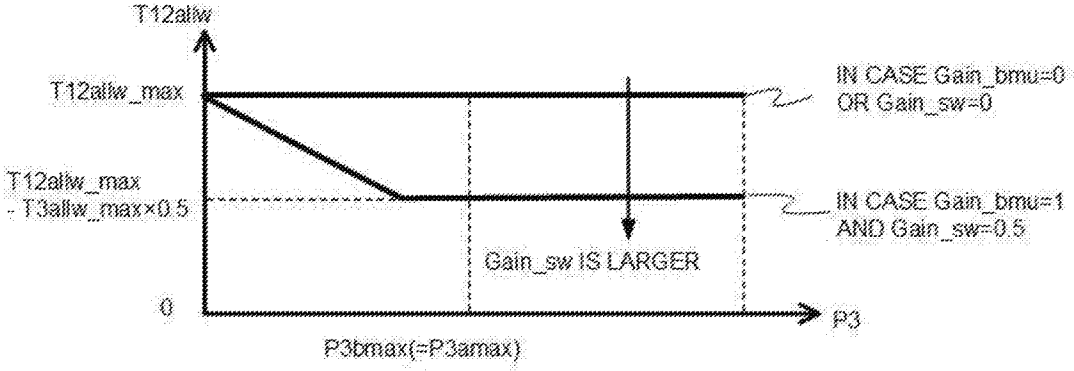
FIG. 12C is a diagram illustrating characteristics of an allowable torque T12allw of a variable-displacement main pump (first hydraulic pump).

FIG. 12C is a diagram illustrating characteristics of the allowable torque T12allw of the variable-displacement main pumps 102 and 202. In FIG. 12C, when a combined operation for swinging and boom raising is performed and the gain Gain_bmu according to boom raising operation is Gain_bmu=1, in a manner corresponding to the allowable torque T3allw_max×0.5 of the main pump 302 (or the torque T3max×0.5 consumed by the main pump 302) being reduced, the allowable torque T12allw of the main pumps 102 and 202 is reduced to a value obtained by subtracting one half of the maximum allowable torque T3allw_max of the main pump 302 from the maximum allowable torque T12allw_max (T12allw_max−T3allw_max×0.5) or a value obtained by subtracting one half of the maximum torque T3max consumed by the main pump 302 from the maximum allowable torque T12allw_max (T12allw_max−T3max×0.5).

~Advantages~

The present embodiment arranged as described above offers the advantages other than the advantage 6, among the advantages 1 through 7 described in the first embodiment.

Third Embodiment

A hydraulic drive system for a construction machine according to a third embodiment of the present invention will be described below with reference to FIGS. 13 and 14.

Figure 13:
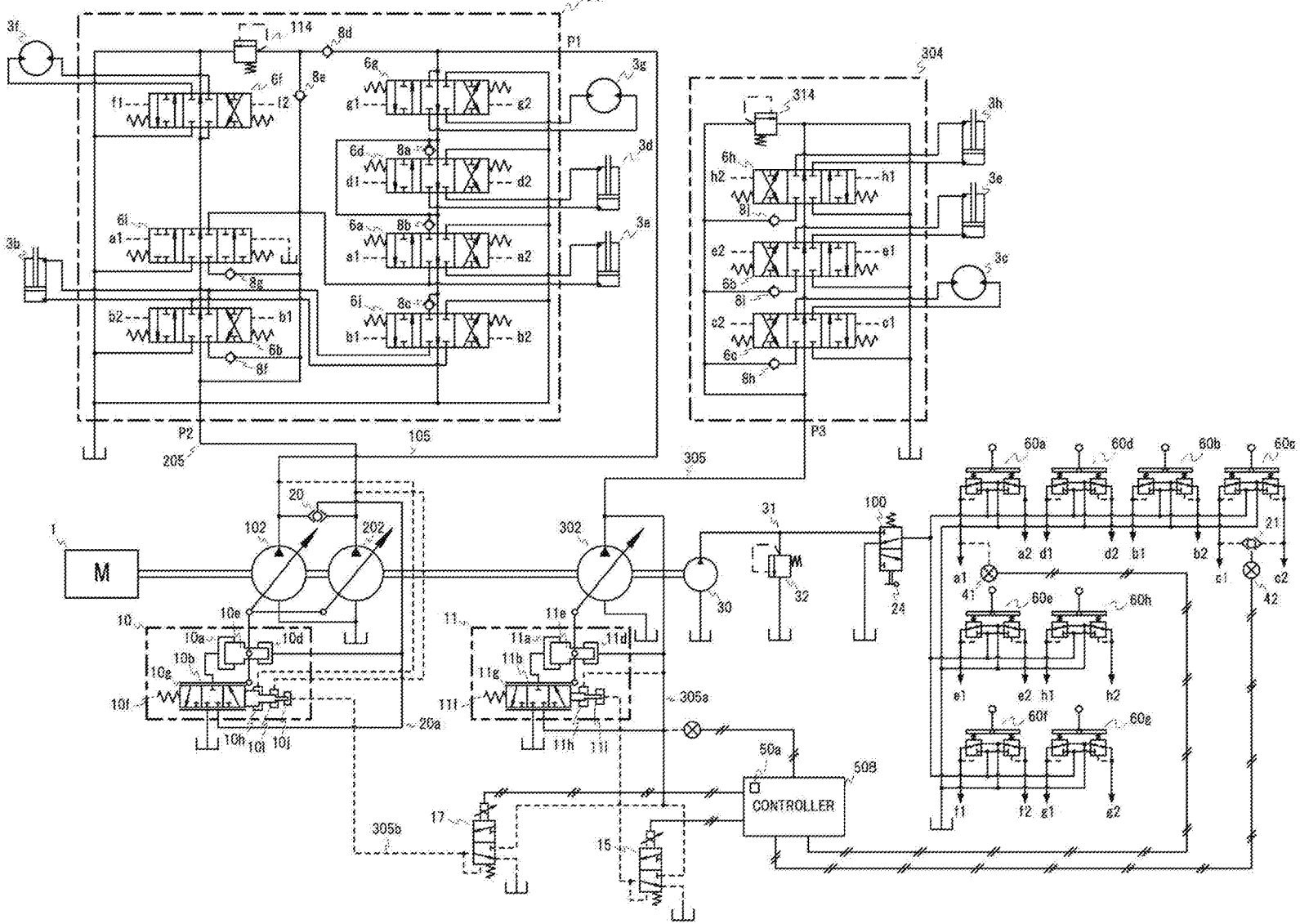
FIG. 13 is a diagram illustrating the configuration of a hydraulic drive system for a construction machine according to a third embodiment of the present invention.

FIG. 13 is a diagram illustrating the configuration of the hydraulic drive system for the construction machine according to the third embodiment of the present invention.

In FIG. 13, the hydraulic drive system according to the present embodiment includes a proportional solenoid valve 17 instead of the variable pressure reducing valve 12. The hydraulic drive system includes a pressure sensor 43 for detecting the pressure P3 in the hydraulic line 305*a* (delivery pressure of the main pump 302) and outputs from the pressure sensors 41, 42, and 43 are introduced to a controller 50B, and an output from the controller 50B is introduced to the proportional solenoid valve 15 and the proportional solenoid valve 17.

Figure 14:
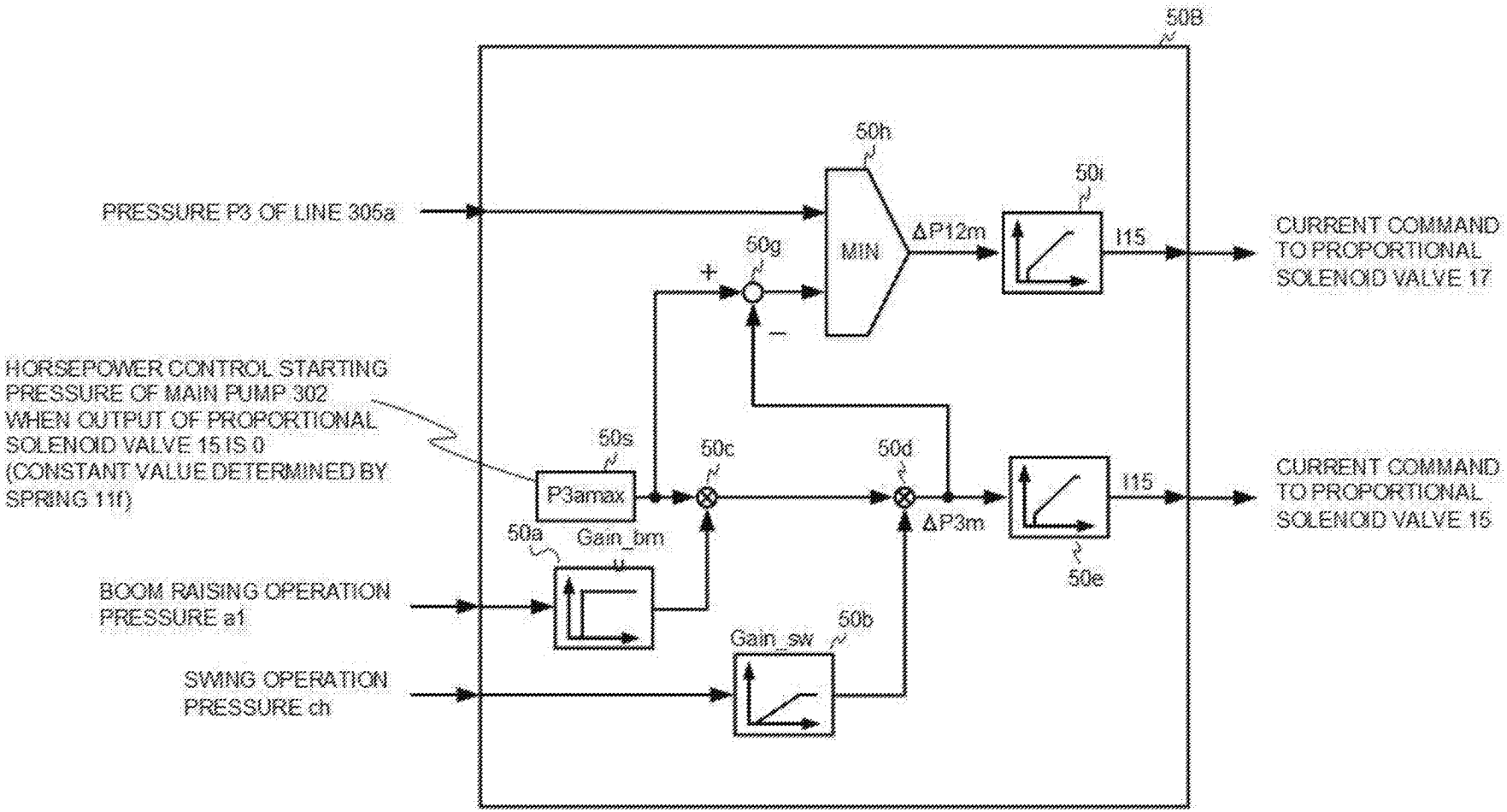
FIG. 14 is a functional block diagram illustrating a function regarding torque feedback control that is performed by a CPU of a controller according to the present embodiment.

FIG. 14 is a functional block diagram illustrating a function regarding torque feedback control that is performed by a CPU 50*a* of the controller 50B according to the present embodiment.

In FIG. 14, the CPU 50A of the controller 50B has, in addition to the setting block 50*s*, the boom raising determining table 50*a*, the swing operation correction table 50*b*, the multipliers 50*c* and 50*d*, and the current command calculating table 50*e*, functions as a subtractor 50*g*, a minimum value selector 50*h*, and a current command calculating table 50*i*.

As described above, the setting block 50*s* has set therein a horsepower control starting pressure P3amax for the second regulator 11 (constant value determined by the spring 11*f* in the second regulator 11). The horsepower control starting pressure P3amax and the correction value ΔP3*m* computed by the multiplier 50*d* are input to the subtractor 50*g*. The subtractor 50*g* determines a value obtained by subtracting the correction value ΔP3*m* computed by the multiplier 50*d* from the horsepower control starting pressure P3amax, as a correction value P3'*m*. The pressure P3 in the hydraulic line 305*a* that is detected by the pressure sensor 43 and the horsepower control starting pressure P3amax are input to the minimum value selector 50*h*, which selects a smaller one of the pressure P3 in the hydraulic line 305*a* and the horsepower control starting pressure P3amax as a correction value ΔP12*m* for a horsepower control starting pressure P12*a* for the first regulator 10.

The correction value ΔP12*m* computed by the minimum value selector 50*h* is input to the table 50*i*, which converts the correction value ΔP12*m* into a current command 117 for driving the proportional solenoid valve 17. The controller 50B then outputs a corresponding current. The proportional solenoid valve 17 is operated by the output current to generate and output an output pressure ΔP12 corresponding to the correction value ΔP12*m*. The output pressure ΔP12 from the proportional solenoid valve 17 is introduced as a correction value for the horsepower control starting pressure (first allowable torque) of the first regulator 10 to the first operation drive section 10*j* of the tilting control valve 10*b*.

~Correspondence to the Scope of Claims~

The proportional solenoid valve 17 serves as a first valve device that generates the first output pressure P3' to feed back the torque consumed by the main pump 302 to the first regulator 10 based on the delivery pressure of the main pump 302.

The first regulator 10 incudes ae first operation drive section 10*j* to which the first output pressure P3' is introduced, and with the first operation drive section 10*j*, the first regulator 10 corrects the horsepower control starting pressure for securing the first allowable torque T12allw so as to be smaller by the first output pressure P3' thereby to control the displacement volumes of the main pumps 102 and 202 (first hydraulic pump) such that the sum of the torques consumed by the main pumps 102 and 202 (first hydraulic pump) and the main pump 302 (second hydraulic pump) does not exceed the predetermined value T12allw_max.

The functions of the setting block 50*s*, the boom raising determining table 50*a*, the swing operation correction table 50*b*, and the multipliers 50*c* and 50*d* of the controller 50 serve as a controller that when the swing motor 3*c* and the boom cylinder 3*a* are driven simultaneously, calculates the correction value ΔP3*m* for the horsepower control starting pressure for reducing the second allowable torque T3allw of the main pumps 102 and 202 (second hydraulic pump) so as to be smaller than the maximum allowable torque T3allw_max at the time when the swing motor 3*c* is driven independently.

The proportional solenoid valve 15 serves as a second valve device for generating the second output pressure ΔP3 corresponding to the above correction value ΔP3*m* calculated by the controller 50.

The second operation drive section 11*i* is included in the second regulator 11, and to which the second output pressure ΔP3 is introduced for correcting the horsepower control starting pressure P3*a* for securing the second allowable torque T3allw so as to be smaller by the second output pressure ΔP3.

The functions of the subtractor 50*g*, the minimum value selector 50*h*, and the current command calculating table 50*i* of the controller 50B serve as an output pressure corrector for limiting the output pressure P3' (first output pressure) of the proportional solenoid valve 17 (first valve device) such that the output pressure P3' (first output pressure) of the proportional solenoid valve 17 (first valve device) does not exceed the horsepower control starting pressure for securing the second allowable torque corrected by the second operation drive section 11*i*.

~Advantages~

The present embodiment arranged as described above offers the same advantages as the advantages 1 through 6 described in the first embodiment.

~Others~

In the above embodiments, the first hydraulic pump for driving the boom cylinder 3*a* includes the two main pumps 102 and 202. However, the first hydraulic pump may include a single hydraulic pump.

The above embodiments have been described as being applied to a construction machine which is a hydraulic excavator having crawler belts on a lower track structure.

However, the construction machine may be of any of other types insofar as they have an upper swing structure and a boom, e.g., a wheeled hydraulic excavator, and those other types offer the same advantages.

DESCRIPTION OF REFERENCE CHARACTERS

1: Prime mover
102, 202: Variable-displacement main pump (first hydraulic pump)
302: Variable-displacement main pump (second hydraulic pump)
3*a* to 3*h*: Actuator
3*a*: Boom cylinder
3*c*: Swing motor
6*a* to 6*j*: Directional control valve
10: First regulator
11: Second regulator
10*a*, 11*a*: Larger-diameter pressure receiving chamber
10*b*, 11*b*: Tilting control valve
10*d*, 11*d*: Smaller-diameter pressure receiving chamber
10*e*, 11*e*: Differential piston
10*f*, 11*f*: Spring
10g, 11g: Spool
10*h*, 10*i*, 10*j*, 10*k*: Operation drive section
10*j*: First operation drive section
11*h*, 11*i*: Operation drive section
11*i*: Second operation drive section
12: Variable pressure reducing valve (first valve device)
12*a*: Spring
12*b*: Pressure receiving section (output pressure corrector)
15: Proportional solenoid valve (second valve device)
17: Proportional solenoid valve (first valve device)
20, 21: Shuttle valve
41, 42: Pressure sensor
50, 50A, 50B: Controller
60*a* to 60*h*: Operation device
50*g*: Subtractor (output pressure corrector)
50*h*: Minimum value selector (output pressure corrector)
104, 304: Control valve block
T12allw: Allowable torque (first allowable torque)
T12allw_max: Maximum allowable torque (predetermined value)
T3allw: Allowable torque (second allowable torque)
T3allw_max: Maximum allowable torque (predetermined value)
ΔP3*m*: Correction value
P3': Output pressure of variable pressure reducing valve 12 (first output pressure)
ΔP3: Output pressure of proportional solenoid valve 15 (second output pressure)
ΔP12*m*: Correction value

The invention claimed is:

1. A hydraulic drive system for a construction machine, the hydraulic drive system comprising:

a plurality of hydraulic pumps including variable-displacement first and second hydraulic pumps driven by a prime mover;

a plurality of actuators driven by hydraulic fluids delivered from the plurality of hydraulic pumps;

a first regulator to which a delivery pressure of the first hydraulic pump is introduced and that controls a displacement volume of the first hydraulic pump such that a torque consumed by the first hydraulic pump does not exceed a first allowable torque;

a second regulator to which a delivery pressure of the second hydraulic pump is introduced and that controls a displacement volume of the second hydraulic pump such that a torque consumed by the second hydraulic pump does not exceed a second allowable torque; and a first valve device that generates a first output pressure to feed back the torque consumed by the second hydraulic pump to the first regulator based on the delivery pressure of the second hydraulic pump, wherein the first regulator includes a first operation drive section to which the first output pressure is introduced and with the first operation drive section, the first regulator corrects a horsepower control starting pressure for securing the first allowable torque so as to be smaller by the first output pressure thereby to control the displacement volume of the first hydraulic pump such that a sum of the torques consumed by the first and second hydraulic pumps does not exceed a predetermined value, and the plurality of actuators include a boom cylinder for driving a boom of a front work implement and a swing motor for driving an upper swing structure, the boom cylinder being driven by a hydraulic fluid delivered by the first hydraulic pump, and the swing motor being driven by a hydraulic fluid delivered by the second hydraulic pump, and wherein the hydraulic drive system further comprises:

a controller that, when the swing motor and the boom cylinder are driven simultaneously, calculates a correction value for the horsepower control starting pressure for reducing the second allowable torque of the second hydraulic pump so as to be smaller than a maximum allowable torque at a time when the swing motor is driven independently;

a second valve device for generating a second output pressure corresponding to the correction value calculated by the controller;

a second operation drive section included in the second regulator and to which the second output pressure is introduced for correcting the horsepower control starting pressure for securing the second allowable torque so as to be smaller by the second output pressure; and an output pressure corrector for limiting the first output pressure of the first valve device such that the first output pressure of the first valve device does not exceed the horsepower control starting pressure for securing the second allowable torque corrected by the second operation drive section.

2. The hydraulic drive system for a construction machine according to claim 1, wherein the first valve device is a variable pressure reducing valve disposed in a hydraulic line to which the delivery pressure of the second hydraulic pump is introduced for generating the first output pressure, the second valve device is a proportional solenoid valve operable based on an output current corresponding to the correction value generated by the controller for generating the second output pressure, and the output pressure corrector comprises a pressure receiving section included in the variable pressure reducing valve and to which the second output pressure of the proportional solenoid valve is introduced for correcting a set pressure of the variable pressure reducing valve so as to be smaller by the second output pressure.

3. The hydraulic drive system for a construction machine according to claim 1, wherein the controller calculates the correction value for the horsepower control starting pressure by multiplying the horsepower control starting pressure for securing the maximum allowable torque of the second hydraulic pump by a magnification ranging from 0 inclusive to 1 exclusive.

4. The hydraulic drive system for a construction machine according to claim 3, further comprising:

a plurality of directional control valves for controlling flows of the hydraulic fluid supplied to the plurality of actuators; and a plurality of operation devices for commanding respective drives of the plurality of actuators for shifting the directional control valves corresponding thereto, wherein the controller inputs an operation signal from one of the plurality of operation devices that commands the drive of the swing motor, and based on the operation signal, calculates the magnification as a value that increases as the operation amount of the operation device increases.

5. The hydraulic drive system for a construction machine according to claim 1, wherein the output pressure corrector is implemented as a function of the controller, the controller selects, as the correction value for the horsepower control starting pressure for securing the first allowable torque of the first hydraulic pump, a smaller one of a value obtained by subtracting the correction value from the horsepower control starting pressure for securing the maximum allowable torque of the second regulator when the swing motor is driven independently and a detected value of the delivery pressure of the second hydraulic pump, and outputs a first current corresponding to the selected value, the controller also outputs a second current corresponding to the correction value for the horsepower control starting pressure for securing the second allowable torque, the first valve device is a first proportional solenoid valve operable based on the first current output from the controller for generating the first output pressure, and the second valve device is a second proportional solenoid valve operable based on the second current output from the controller for generating the second output pressure.

* * * * *